US005453571A

United States Patent [19]

Adachi et al.

[11] Patent Number: 5,453,571

[45] Date of Patent: Sep. 26, 1995

[54] ELECTRONIC MUSICAL INSTRUMENT HAVING KEY AFTER-SENSORS AND STROKE SENSORS TO DETERMINE DIFFERENCES BETWEEN KEY DEPRESSIONS

[75] Inventors: Takeshi Adachi, Hamakita; Yasuhiko Asahi, Hamamatsu; Satoshi Suzuki, Hamamatsu; Jun-ichi Mishima, Hamamatsu, all of Japan

[73] Assignee: Yamaha Corporation, Hamamatsu, Japan

[21] Appl. No.: 20,858

[22] Filed: Feb. 19, 1993

Related U.S. Application Data

[63] Continuation of Ser. No. 771,740, Oct. 4, 1991, abandoned.

[30] Foreign Application Priority Data

Oct. 9, 1990 [JP] Japan ..... 2-270690

[51] Int. Cl.[6] ..... G10H 5/00

[52] U.S. Cl. ..... 84/658; 84/626; 84/687; 84/744

[58] Field of Search ..... 84/626, 627, 629, 84/658, 662, 663, 687, 737, 744, 745, DIG. 7

[56] References Cited

U.S. PATENT DOCUMENTS

| | | | |
|---|---|---|---|
| 3,927,593 | 12/1975 | Kawamura | 84/DIG. 7 X |
| 4,079,651 | 3/1978 | Matsui | 84/DIG. 7 X |
| 4,195,545 | 4/1980 | Nishimoto . | |
| 4,314,227 | 2/1982 | Eventoff | 84/DIG. 7 X |
| 4,416,178 | 11/1983 | Ishida | 84/DIG. 7 X |
| 4,506,581 | 3/1985 | Sunada | 84/DIG. 7 X |
| 4,528,885 | 7/1985 | Chihana . | |
| 4,668,843 | 5/1987 | Watanabe et al. | 84/DIG. 7 X |
| 4,979,423 | 12/1990 | Watanabe | 84/DIG. 7 X |
| 5,012,715 | 5/1991 | Matsunaga et al. | 84/724 |
| 5,062,342 | 11/1991 | Nagatsuma | 84/744 |
| 5,144,876 | 9/1992 | Hirano | 84/DIG. 7 X |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical instrument includes a key support portion, a plurality of keys pivotally supported on the key support portion, a musical tone signal generator, after sensors, and a musical tone signal control unit. The musical tone signal generator generates a musical tone signal corresponding to each of the plurality of keys. Each after sensor has a plurality of sensors and is arranged in correspondence with the plurality of keys and operated near key depression end positions to for independently generate pieces of key information. The musical signal control unit controls the musical tone signal generator on the basis of the key information.

23 Claims, 26 Drawing Sheets

C1BUF
COBUF

| ADDRESS i | KEY CODE |
|---|---|
| 0 | KC12 |
| 1 | KC15 |
| 2 | KC50 |
| 3 | 0 |
| ⋮ | ⋮ |
| 7 | 0 |

CTACT

| ch ($n_0$) | KEY CODE |
|---|---|
| 1 | KC21 |
| 2 | KC30 |
| 3 | 0 |
| 4 | KC58 |
| ⋮ | ⋮ |
| 16 | 0 |

KONBUF
KOFBUF

| ADDRESS i | MARK | KEY CODE |
|---|---|---|
| 0 | 0 | KC12 |
| 1 | 1 | KC30 |
| 2 | 0 | KC15 |
| 3 | 1 | KC44 |
| ⋮ | ⋮ | ⋮ |
| 7 | | 0 |

ELECTRONIC MUSICAL INSTRUMENT HAVING KEY AFTER-SENSORS AND STROKE SENSORS TO DETERMINE DIFFERENCES BETWEEN KEY DEPRESSIONS

This is a continuation of application Ser. No. 07/771,740, filed Oct. 4, 1991, now abandoned.

BACKGROUND OF THE INVENTION

The present invention relates to various types of electronic musical instruments such as an electronic organ and an electronic piano, particularly, to a technique for enriching expressions of electronic musical instruments and, more particularly, to a technique for faithfully reflecting the will of a performer of the electronic musical instrument on a musical tone generated by the electronic musical instrument.

As a conventional method of adding a musical expression to a musical tone generated by an electronic keyboard musical instrument, initial touch control for detecting a key depression speed to control a musical tone, after touch control for detecting a pressure further acting on the depressed key to control a musical tone, and the like are performed.

In addition, a lateral movement of a keyboard as a whole is detected to provide a touch vibrato.

As described in U.S. Pat. No. 4,079,651, an L-shaped conductive elastic member is used and deformed upon key depression, a plurality of stationary contacts respectively connected to resistors are sequentially short-circuited to shift a contact position with a band-like resistor, thereby detecting a change in resistance and hence performing touch control.

As shown in Japanese Utility Model Laid-Open Nos. 63-195389 and 63-195380, a depression force upon key depression or the like is detected by a pressure-sensitive sensor to perform musical tone control is also proposed.

In addition, as shown in Japanese Patent Laid-Open No. 53-31001, a keyboard portion can be slightly moved laterally as a whole, a slit board having two through holes for symmetrically changing amounts of light transmitted through the through holes in correspondence with lateral movements is arranged, and optical signals obtained through the through holes are operatively detected and are used to control a musical tone.

Furthermore, as described in U.S. Pat. No. 4,314,227, there is provided an electronic musical instrument having nonstroke keys operable upon selective touching of patterns representing shapes of a large number of keys, wherein an output from a pressure-sensitive sensor is changed in accordance with a touch position and a touch force, thereby controlling a musical tone.

Japanese Patent Publication No. 53-5545 discloses a key depression speed detector of an electronic musical instrument to assign a touch response effect, wherein a switch is operated in synchronism with key depression, the number of clock pulses from a timing when its movable contact is connected to a normally closed stationary contact to a timing when the movable contact is connected to a normally open stationary contact is counted, a count output is obtained in correspondence with the key depression speed, and parameters such as the amplitude, frequency, tone color, and phase upon switching are determined in accordance with the count output.

This is a touch sensitive apparatus of the electronic musical instrument wherein the switch is utilized as a contact time difference switch.

A keyboard apparatus for an electronic keyboard musical instrument includes a plurality of keys pivotally supported on at least a key support member, and key switches which are turned on upon operations of the corresponding keys to control generation of musical tone signals.

In recent years, the following structure is very popular, as described in Japanese Utility Model Laid-Open No. 64-55990. Movable portions of key switches corresponding to the respective keys are protruded in a doom-like shape from the common base (for all keys) made of an elastic material such as synthetic rubber. The doom-like projection is deformed upon depression of a key, so that a movable contact in this projection is brought into contact with the paired fixed projection on a printed circuit board, thereby obtaining an electrical connection.

In addition, as described in Japanese Utility Model Laid-Open No. 61-198997, two key switches having the above arrangement are arranged at two different longitudinal positions for each key, and a difference between the ON time of one key switch and the ON time of the other key switch upon depression of the corresponding key is detected to perform touch response control.

Moreover, a presensor such as a stroke sensor for outputting a signal corresponding to a key depression stroke is arranged to attempt control of a musical tone in accordance with information prior to the normal key ON operation.

These conventional electronic musical instruments and input apparatuses for controlling their musical tones can only perform musical tone control common to all the keys. Even if a key depression speed and a key depression force can be detected in units of keys, only one type of signal is detected for each key. Therefore, only simple musical tone control can be provided to result in poor musical expressions.

In the conventional touch sensitive apparatus for the electronic musical instrument, a musical tone is controlled in accordance with only a time, i.e., a time interval value, required for switching the switch (contact time difference switch). This control is nothing to do with control of different switching states (i.e., the speed of the movable contact separated from the normally closed contact or the speed of the movable contact brought into contact with the normally open contact) caused by ways of key depression. Therefore, delicate musical tone expressions are impossible.

For example, in an actual musical performance by an electronic keyboard musical instrument performer, finger movements prior to the key ON operation or after the key OFF operation naturally express an attack (rise of a musical tone) or a release (a lingering tone). If these finger movements are reflected on the music, a more expressive music can be produced.

In a conventional electronic keyboard musical instrument, although key depression and key release (key ON and OFF), an initial strength upon key depression, an after touch during key depression, and the like can be detected and reflected on musical tones, contact states between the fingers and the key board in a state immediately prior to the key ON operation and a state immediately after the key OFF operation cannot be detected.

In a piano (acoustic piano), a tone color upon striking of a key is not determined by only a key depression strength and a key depression speed, but is delicately changed in accordance with the way of striking a key and the way of releasing a finger from the depressed key.

For example, a performance by striking a key from a state in which a finger is kept placed on this key (i.e., the key depression speed is abruptly increased from the initial speed=0) and a performance by striking a key by downward movement of a finger onto the key (the key depression speed is increased at almost the constant speed from the start to key depression) produce different tone colors although the key depression strengths are equal to each other.

An action in which the finger is slowly released from the depressed key and an action in which the finger is quickly released from the depressed key provide different lingering tone colors due to the following reason.

For example, when a key is gradually released, a damper is brought into contact with vibrating strings, and the tone color is gradually changed. When the finger is perfectly released from the key, vibrations of the strings are stopped, and the tone is perfectly stopped.

Therefore, different lingering tone colors are obtained until the tones are stopped in accordance with different finger release methods.

In the electronic keyboard musical instrument using the conventional electronic touch sensitive apparatus, the tone color and the volume level are solely determined in accordance with the final key depression speed regardless of different key depression methods. Control is nothing to do with actual key movements. At the time of a key release, a simple tone decay occurs in accordance with the time when the key is released. The tones are decayed independently of key release speeds and key movements (i.e., the finger is abruptly released from the key, the finger is released as if the finger plunks the key, or the finger is gradually released from the key).

It is, therefore, impossible to obtain a performance and expressions as in an acoustic piano.

In the conventional electronic musical instrument described above, only generation of musical tones can be controlled by key switches, and an expressive musical performance cannot be made. In an arrangement having two keys switches as touch response switches for each key, although a musical tone can be changed in accordance with a key depression speed, a satisfactory emotional expression cannot be obtained.

By arranging a presensor such as a stroke sensor, its information is combined with key depression speed information from the touch response switch to make an expressive performance which reflects the will of the performer.

Since the conventional all-sensing stroke sensors have complicated structures and are arranged independently of the key switches, the keyboard structure is complicated, and its assembly is complicated accordingly.

SUMMARY OF THE INVENTION

It is an object of the present invention to provide an electronic musical instrument for allowing a performer to make an expressive musical performance which faithfully reflects the will of a performer.

It is another aspect of the present invention to provide an electronic musical instrument capable of realizing after control and a touch vibrato.

It is still another aspect of the present invention to provide an electronic musical instrument capable of changing a tone color and a volume level in accordance with a key depression method at the time of key depression and a key release method at the time of key release.

It is still another object of the present invention to provide an electronic musical instrument capable of performing delicate touch response control.

It is still another object of the present invention to provide an electronic musical instrument in which a structure of a keyboard apparatus having key switches and stroke switches can be simplified and easily assembled, and maintenance and inspection can be facilitated.

It is still another object of the present invention to provide an electronic musical instrument in which a wiring structure of a keyboard apparatus having key switches and stroke switches is simplified.

It is still another object of the present invention to provide an electronic musical instrument which facilitates the manufacture of a printed circuit board.

In order to achieve the above objects of the present invention, there is provided an electronic musical instrument comprising a key support portion, a plurality of keys pivotally supported on the key support portion, musical tone signal generating means for generating a musical tone signal corresponding to each of the plurality of keys, after sensors each having a plurality of sensors, arranged in correspondence with each of the plurality of keys and operated near key depression end positions, for independently generating pieces of key information, and musical tone signal control means for controlling the musical tone signal generating means on the basis of the key information.

DESCRIPTION OF THE PREFERRED EMBODIMENT

A preferred embodiment of the present invention will be described in detail below.

Keyboard Apparatus

Figure 1:
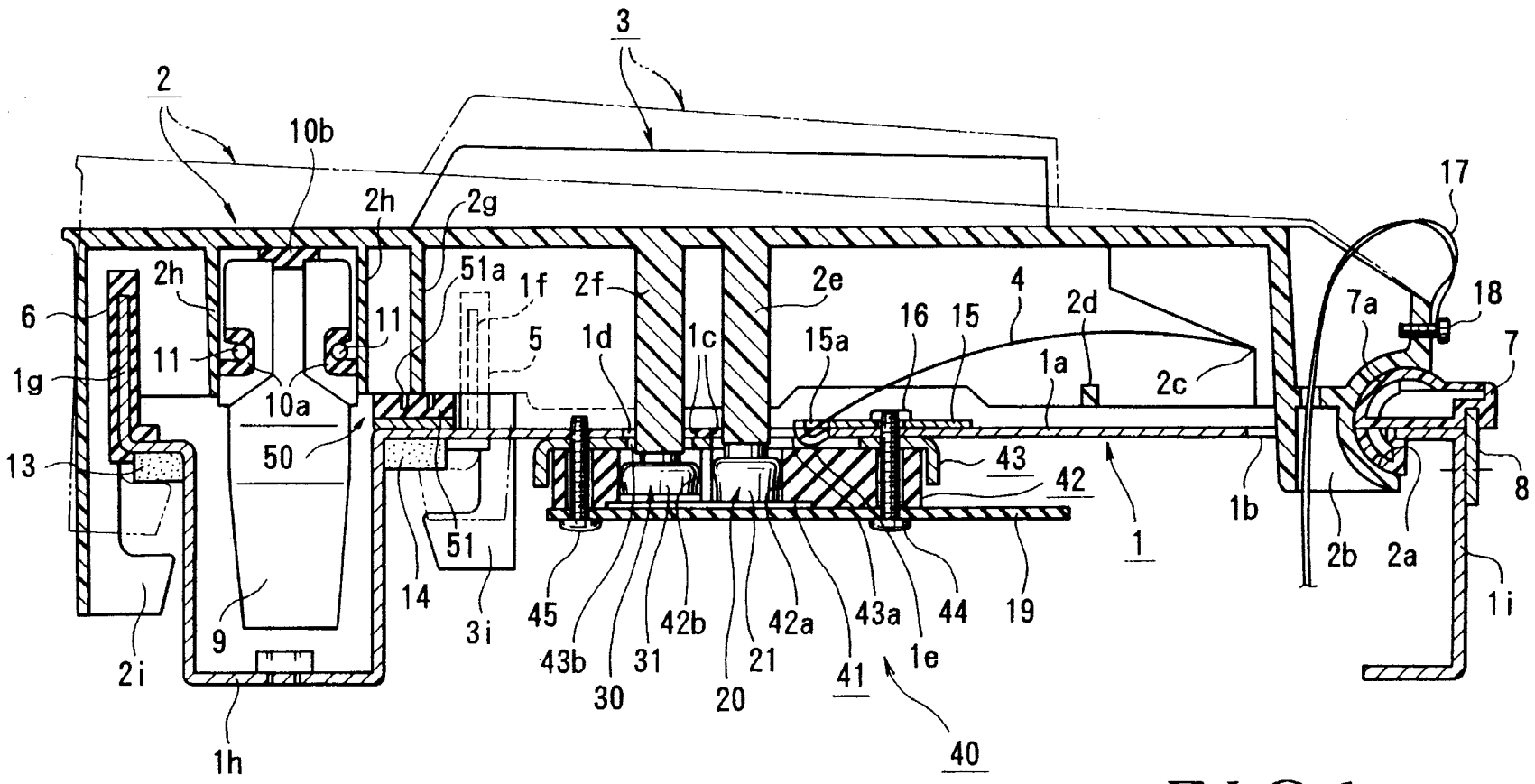
FIG. 1 is a longitudinal sectional view of a white key portion of a keyboard apparatus in an electronic keyboard musical instrument according to an embodiment of the present invention.
Figure 2:
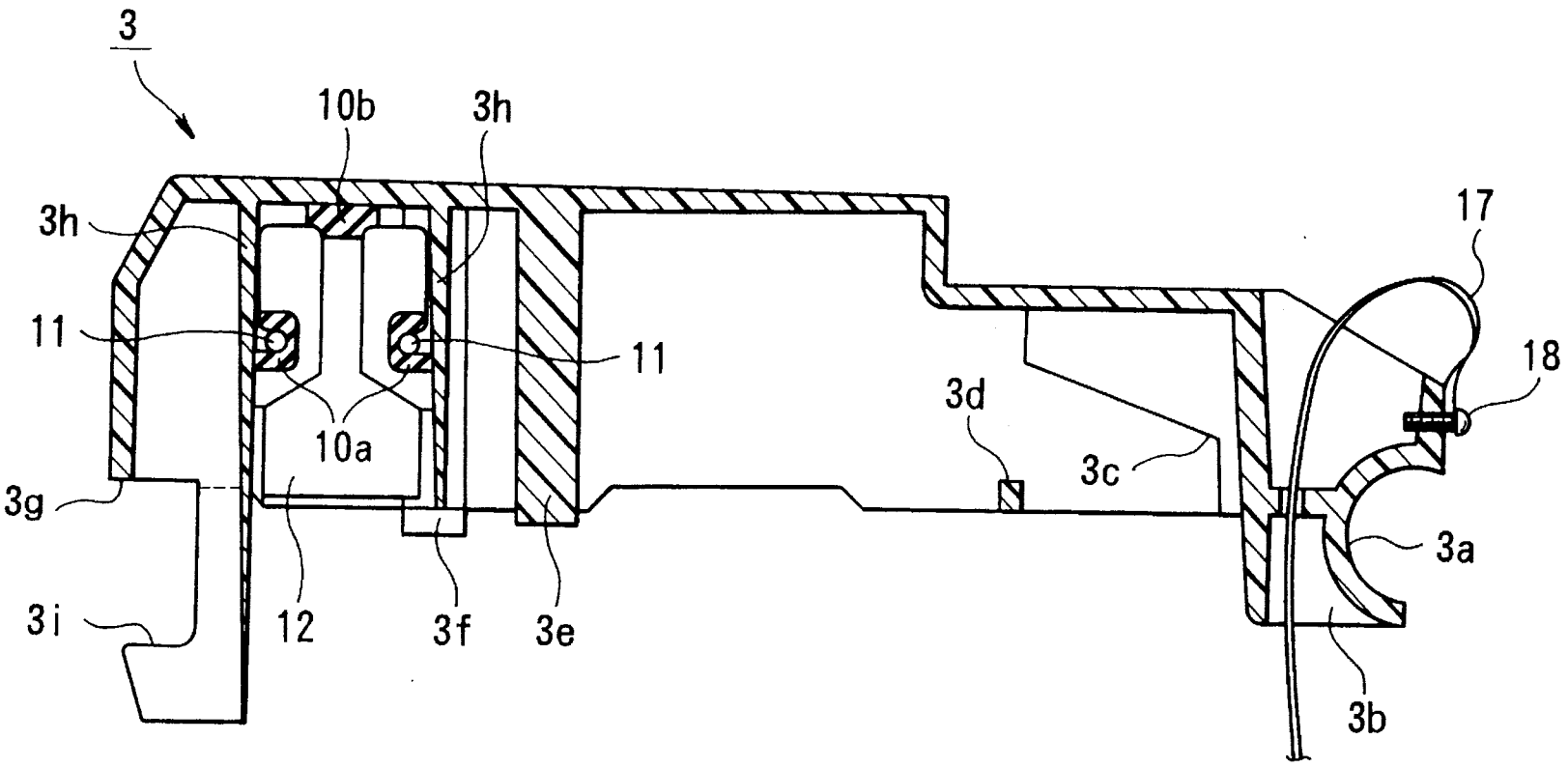
FIG. 2 is a longitudinal sectional view of a black key portion of the keyboard apparatus shown in FIG. 1.
Figure 3:
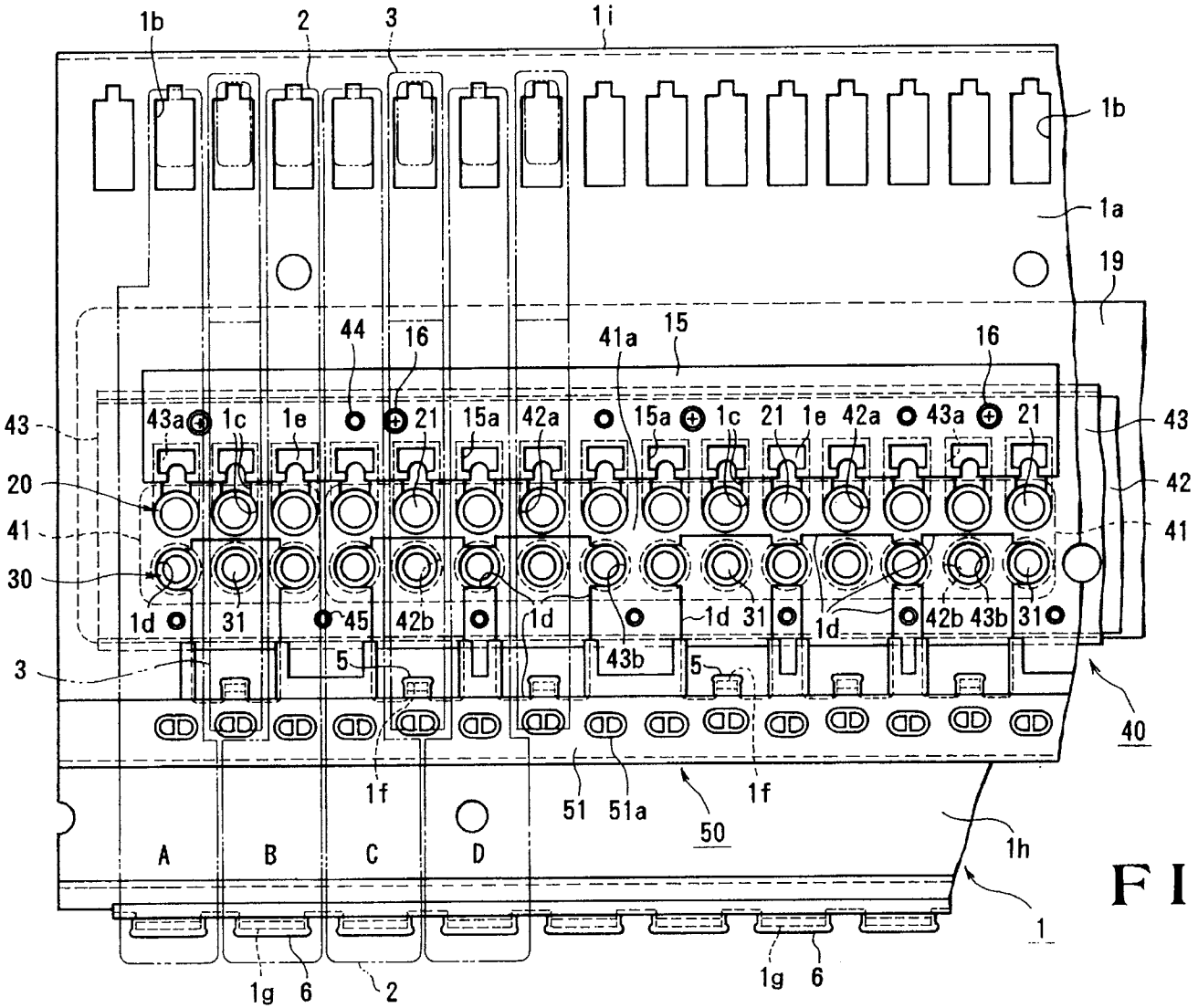
FIG. 3 is a plan view showing the keyboard apparatus of FIG. 1 in a state wherein a bass key side is removed.

FIG. 1 shows a white key portion of a keyboard apparatus serving as an input apparatus of an electronic musical instrument according to an embodiment of the present invention, FIG. 2 shows only a black key portion of this keyboard apparatus, and FIG. 3 shows the keyboard apparatus in a state wherein a bass key side is removed (some keys are indicated by alternate long and two short dashed lines).

In this keyboard apparatus, reference numeral 1 denotes a keyboard frame obtained by bending a metal plate such as an iron plate. The keyboard frame 1 pivotally supports large numbers of white and black keys 2 and 3 aligned on the upper portion thereof.

The keyboard frame 1 has a key fitting hole 1*b* corresponding to each of the keys 2 and 3 at a rear portion of a horizontal portion 1*a*. The keyboard frame 1 also has a stroke sensor actuator insertion hole 1*c*, a touch response switch actuator insertion hole 1*d*, and a spring retainer press portion 1*e*. The stroke sensor actuator insertion hole 1*c* is located adjacent to an intermediate portion of the horizontal portion 1*a* along the longitudinal direction of the key and is arranged in correspondence with each key. As shown in FIG. 3, the touch response switch actuator insertion hole 1*d* extends by a length corresponding to a plurality of keys. The spring retainer press portion 1*e* is formed by pressing to lock the front end of each corresponding key return spring 4. An upright piece if mounted with a rubber or plastic black key guide 5 corresponding to each black key 3 and an upright piece 1*g* mounted with a rubber or plastic white key guide 6 at the front end portion in correspondence with each white key 2 are formed to interpose a channel-like recessed portion 1*h* formed along the direction of the array of the keys 2 and 3.

The white and block keys 2 and 3 comprise integral bodies made of a synthetic resin, respectively.

As shown in FIG. 1, each white key 2 has a fitting projection 2*b*, a spring retainer 2*c*, a spring removal preventing portion 2*d*, a stroke sensor actuator 2*e*, a touch response switch actuator 2*f*, an after sensor actuator 2*g*, a counterweight holding portion 2*h*, and an upper limit stopper piece 2*i*. The fitting projection 2*b* has a semicylindrical recessed portion 2*a* at its rear end portion. The spring retainer 2*c* and the spring removal preventing portion 2*d* are located in front of the fitting projection 2*b* to lock the rear end of the corresponding key return spring 4. The actuators 2*e* and 2*f* are located adjacent to the intermediate portion and suspend downward from the inner surface of the intermediate portion in the longitudinal direction of the key. The actuator 2*g* and the counterweight holding portion 2*h* are located in front of the actuators 2*f* and 2*g*. The upper limit stopper piece 2*i* is suspended downward from the front end portion and is bent backward.

The counterweight holding portion 2*h* holds an inertia moment increasing counterweight 9 by a pin 11 through a dampening rubber piece 10*a*. Reference numeral 10*b* denotes a dampening rubber piece, too.

As shown in FIG. 2, each black key 3 has a fitting projection 3*b*, a spring retainer 3*c*, a spring removal preventing portion 3*d*, a stroke sensor actuator 3*e*, a touch response switch actuator 3*f*, and an upper limit stopper piece 3*i*. The fitting projection 3*b* has a semicylindrical recessed portion 3*a* at its rear end portion. The spring retainer 3*c* and the spring removal preventing portion 3*d* are located in front of the fitting projection 3*b* to lock the rear end of the corresponding key return spring 4. The actuators 3*e* and 3*f* are located adjacent to the intermediate portion and suspend downward from the inner surface of the intermediate portion in the longitudinal direction of the key. The upper limit stopper piece 3*i* is suspended downward from the front end portion and is bent forward.

The upper portions of the touch response switch actuator 3*f* and the upper limit stopper piece 3*i* also serve as a counterweight holding portion. A counterweight 12 is held between these upper portions by a pin 11 through dampening rubber pieces 10*a* and 10*b*.

The lower surface of the front end of this black key 3 serves as an after sensor actuator 3*g*.

The fitting projections 2*b* and 3*b* of the white and black keys 2 and 3 are fitted into the key fitting holes 1*b* of the keyboard frame in a predetermined array. Semicylindrical portions 7*a* of key support pieces 7 engaged with the rear edges of the key fitting holes 1*b* of the keyboard frame 1 are respectively fitted in the semicylindrical recessed portions 2*a* and 3*a*. A common key removal preventing plate 8 is fitted on the key support pieces 7 and is screwed on an upright surface 1*i* of the rear end of the keyboard frame 1. Therefore, the keys 2 and 3 are pivotally supported on the keyboard frame 1 while their removal can be prevented.

The keyboard frame 1, the key support pieces 7, and the key removal preventing plate 8 constitute a key support portion.

Since each key return spring (leaf spring) 4 is engaged between each spring retainer press portion 1*e* of the keyboard frame 1 and each spring retainer 2*c* of each of the white and black keys 2 and 3. The white and black keys 2 and 3 are always biased upward. In a normal state (nondepression state), the upper limit stopper pieces 2*i* and 3*i* of the front end portions of each white key 2 and each black key 3 abut against felt members 13 and 14 serving as upper limit stoppers adhered to the lower surface of the keyboard frame 1. The white and black keys 2 and 3 are locked at upper limit positions indicated by the alternate long and two short dashed lines in FIG. 1. Solid lines indicate lower limit positions of the depression strokes of the white and black keys 2 and 3.

Lateral vibrations of the white and black keys 2 and 3 upon key depression are prevented by the key guides 6 and 5, respectively.

A 15-key subframe 15 having rectangular central spring retainer holes 15*a* is fixed by screws 16 on the upper surface of the intermediate portion of the horizontal portion 1*a* of the keyboard frame 1 in correspondence with the respective spring retainer press portions 1*e*, as shown in FIG. 3. Locking by the key return spring 4 is assured so as not to remove the front end of each key return spring 4 from the corresponding spring retainer press portion 1*e*.

The upper surface of each of the white and black keys 2 and 3 of the keyboard apparatus is plated with a metal (e.g., NiCr) and also serves as a contact sensor. One end of a lead wire 17 is connected to the rear end portion of each metal-plated surface by a spring 18. A signal from the contact sensor constituted by the metal-plated surface is extracted from the lead wire 17.

Another method of forming a key with a contact sensor is to form an entire key by a conductive resin, or to form it by a two-color forming method using a conductive resin and a nonconductive resin.

Other sensors and switches arranged in this keyboard apparatus will be described below.

A stroke sensor 20 and a 2-make touch response switch 30 serving as a contact time difference switch are arranged on a printed circuit board 19 below the keyboard frame 1 in correspondence with each of the keys 2 and 3. Movable projections 21 and 31 of the sensor 20 and the switch 30 are integrally formed by a rubber unit 41. The rubber unit 41 is positioned by an insulating spacer 42, and the sensor unit 40 covered with a sensor cover made of an iron plate or resin covers the upper surface of the rubber unit 41 and is fixed on the keyboard frame 1 by a plurality of screws 44 and 45 from the lower direction.

The movable projections 21 and 31 of the stroke sensors 20 and the touch response switches 30, which correspond to three keys, are covered by one bass rubber unit 41, and which correspond to 12 keys (one octave), are covered by other rubber units 41, as shown in FIG. 3.

Deep holes 42*a* and 42*b* are formed in the spacer 42 to receive the movable projections 21 and 31 of the rubber units 41. The sensor cover 43 has a window hole 43*a* extending from the actuator insertion hole 1*c* of the keyboard frame 1 to the lower side of the spring retainer hole 15*a* of the subframe 15, and a circular hole 43*b* corresponding to the movable projection 31 of the touch response switch 30.

The stroke sensor 20 and the touch response switch 30 arranged in the sensor unit 40 serve as an initial sensor operated during depression of each of the keys 2 and 3. FIG. 1 shows a state wherein the movable projections 21 and 31 are pressed by the actuators 2e and 2*f* after the white key 2 is depressed to the lower limit position.

The actuators 2*e*, 2*f*, 3*e*, and 3*f*, the stroke sensor 20, and the touch response switch 30 are mounted on the printed circuit board 19 together with the spacer 42 and the sensor cover 43, as described above. However, the spacer may be eliminated to shorten the actuators by a length corresponding to the thickness of the spacer, thereby projecting the movable projections 21 and 31 upward.

With the above arrangement, the sensor cover can be omitted. In addition, only the holes 1*c* formed in the keyboard frame 1 are required to position the stroke sensors 20 and the touch response switches 30.

The details of the stroke sensor 20 and the touch response switch 30 will be described in detail later.

An elongated after sensor unit 50 extending across all the keys along the direction of the array of the keys 2 and 3 is formed along the front edge of the horizontal portion 1*a* of the keyboard frame 1. The upper portion of the after sensor unit 50 is formed by a silicone rubber pad 51. The after sensor unit 50 also serves as a lower limit stopper dampening member for regulating the lower limit positions of the keys 2 and 3 when the after sensor actuators 2*g* and 2*g* abut against the silicone rubber pad 51.

Grooves 51*a* each obtained by dividing an ellipse into two parts are formed in the silicone rubber pad 51 in correspondence with the respective sensor portions of the keys 2 and 3, thereby increasing sensing sensitivity. When the after sensor actuators 2*g* and 3*g* are brought into contact with the sensor portion and urges it near depression end positions of the keys 2 and 3, independent analog outputs are outputted from analog sensors (to be described later). The structure of the after sensor unit 50 will be described in detail later.

Stroke Sensor and Touch Response Switch

Figure 4:
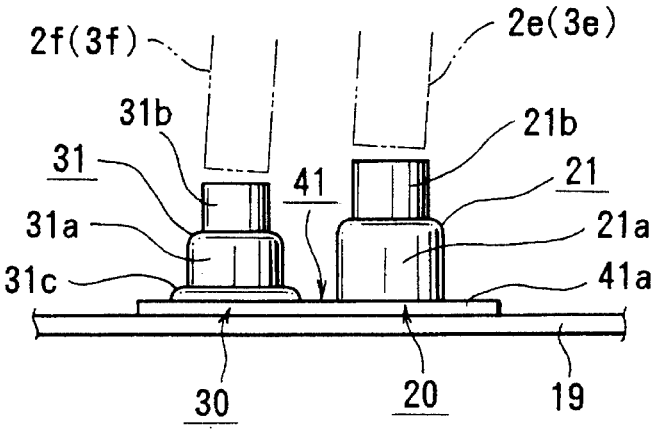
FIG. 4 is a side view showing a pair of stroke sensor and a touch response switch shown in FIG. 1 in a nondepression state.
Figure 5:
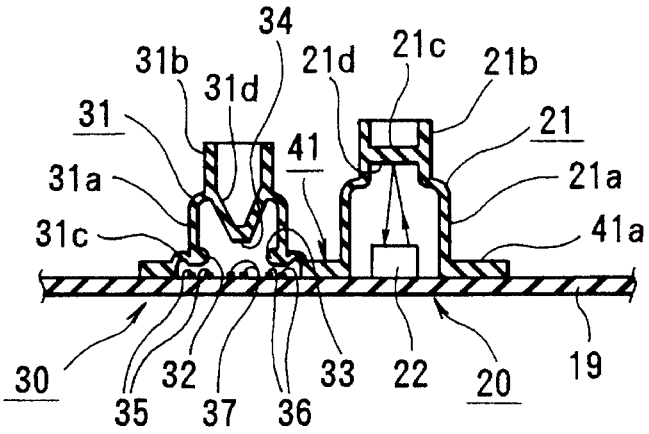
FIG. 5 is a sectional view of the pair of stroke and touch response switches along the longitudinal direction of the key in FIG. 1.

FIGS. 4 and 5 show a state in which a pair (corresponding to one key) of stroke sensor 20 and touch response switch 30 are set in a nondepression state.

The stroke sensor 20 and the touch response switch 30 are constituted by the printed circuit board 19 and the rubber unit 41 integrally formed therewith. The rubber unit 41 integrally has the movable projection 21 of the stroke sensor 20 and the movable projection 31 of the touch response switch 30, which are adjacent to each other and integrally protrude upward from a common flat portion 41*a* made of an elastic material such as synthetic rubber.

The movable projection 21 of the stroke sensor 20 has a relatively thick-walled cylindrical operation portion 21*b* integrally formed on a relatively thin-walled doom-like flexible portion 21*a*. As shown in FIG. 5, the lower surface of a partition wall 21*c* in the operation portion 21*b* serves as a smooth surface (mirror surface) 21*d* having a color of a high reflectance (e.g., white).

A photointerrupter 22 constituted by a reflection photosensor consisting of a light-emitting diode and a phototransistor is arranged on the printed circuit board 19 at a position opposite to the smooth surface 21*d*.

When the operation portion 21*b* is depressed by the stroke sensor actuator 2*e* or 3*e* (FIG. 4) of the white or black key 2 or 3 upon key depression, the flexible portion 21*a* expands radially and is deformed, and the smooth surface 21*d* is moved downward accordingly.

Light emitted from the light-emitting diode of the photointerrupter 22 is reflected by the smooth surface 21*d*, and the reflected light is incident on the phototransistor. An output representing a given stroke is converted into an analog electrical signal, and this signal is outputted.

The movable projection 31 of the touch response switch 30 integrally comprises a thin-walled first flexible portion 31*c* expanding from a flat portion 41*a* so as to have a ring-like shape, a doom-like second flexible portion 31*a* extending upward from the first flexible portion 31*c*, a relatively thick-walled cylindrical operation portion 31*b* formed on the second flexible portion 31*a*, and an inverted frustoconical second movable contact holding portion 31*d* suspended inside the second flexible portion 31*a* from its upper end, as shown in FIG. 5.

A pair of arcuated first movable contacts 32 and 33 are formed by thin conductive rubber pieces adhered on the lower surface of the ring-like portion of the relatively thick-walled portion of the lower edge of the second flexible portion 31*a*. A circular second movable contact 34 is formed by a thin conductive rubber piece adhered to the lower surface of the second movable contact holding portion 31*d*.

Two pairs of first stationary contacts 35 and 36 constituted by the conductive patterns are formed on the printed circuit board 19 at positions opposite to the first movable contacts 32 and 33. A pair of second stationary contacts 37 are formed at positions opposite to the second movable contact 34 between the first movable contacts 32 and 33. The details of the movable and stationary contacts will be made later.

When the operation portion 31*b* is depressed by the touch response switch actuator 2*f* or 3*f* (FIG. 4) of the white or black key 2 or 3 during key depression, the operation portion 31*b* causes the first flexible portion 31*c* to deform, so that the first flexible portion 31*c* is moved downward together with the second flexible portion 31*a*. The first movable contacts 31 and 33 are brought into contact with the first stationary contacts 35 and 36 to render the paired contact pattern conductive (i.e., first make switches S1*a* and S1*b* to be described in detail later are turned on).

When the operation portion 31*b* is further depressed, the second flexible portion 31*a* is deformed and expands radially. The second movable contact holding portion 31*d* is moved downward together with the operation portion 31*b*. The second movable contact 34 formed on the lower surface of the second movable contact holding portion 31*d* is brought into contact with the second stationary contacts 37, thereby rendering the paired contact pattern conductive (i.e., a second make switch S2 to be described in detail later is turned on).

Details of the printed circuit board 19 and the stationary contact side of the touch response switch 30 will be made with reference to FIGS. 6 to 8.

Figure 6:
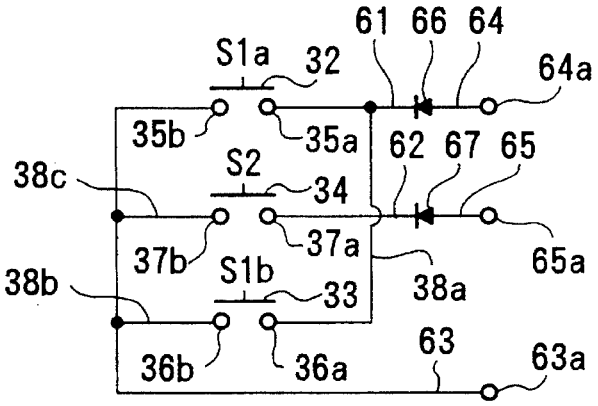
FIG. 6 is a wiring diagram of a pair of touch response switches on a printed circuit board.
Figure 7:
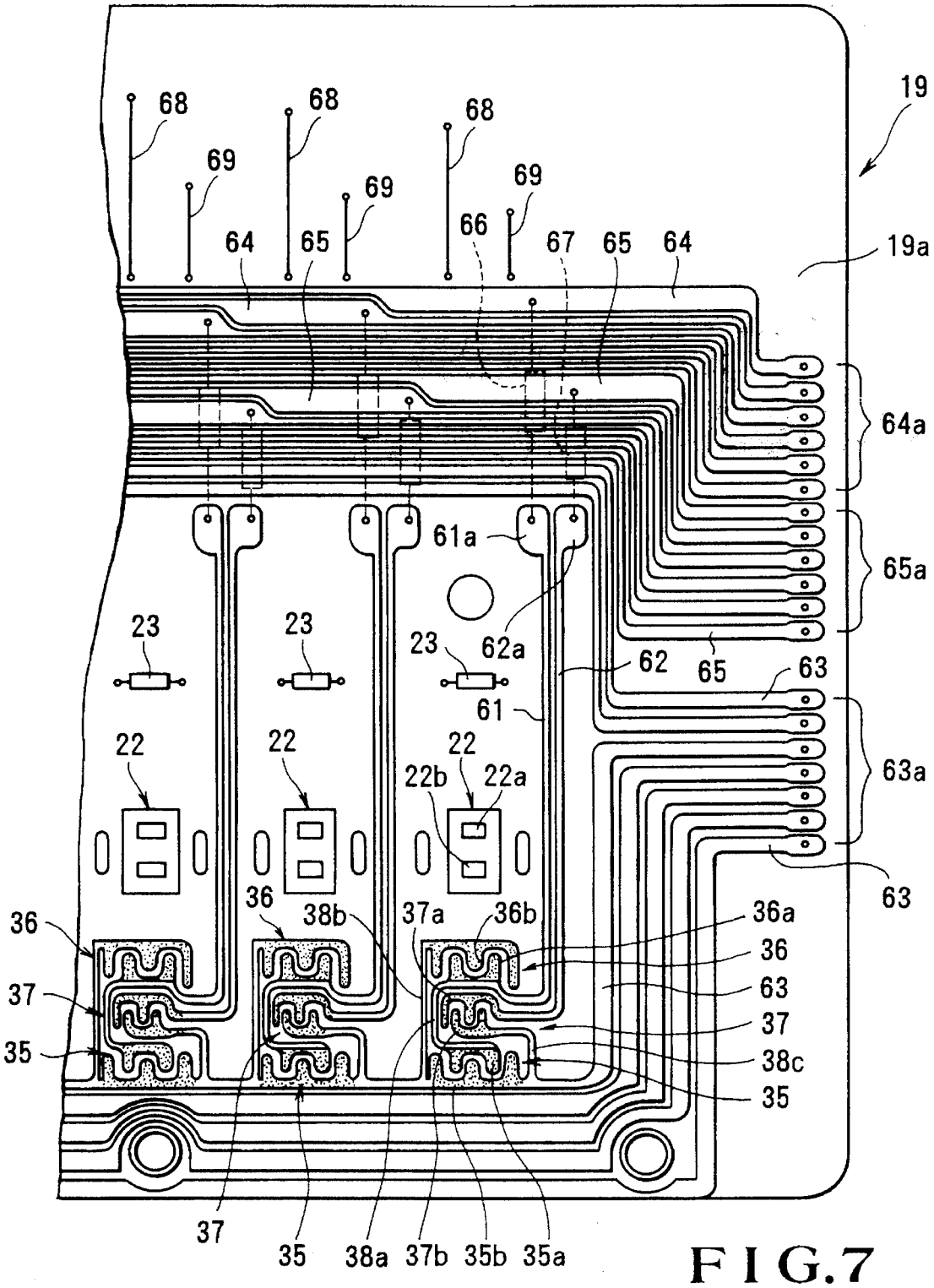
FIG. 7 is a plan view showing the right end portion of the printed circuit board.
Figure 8:
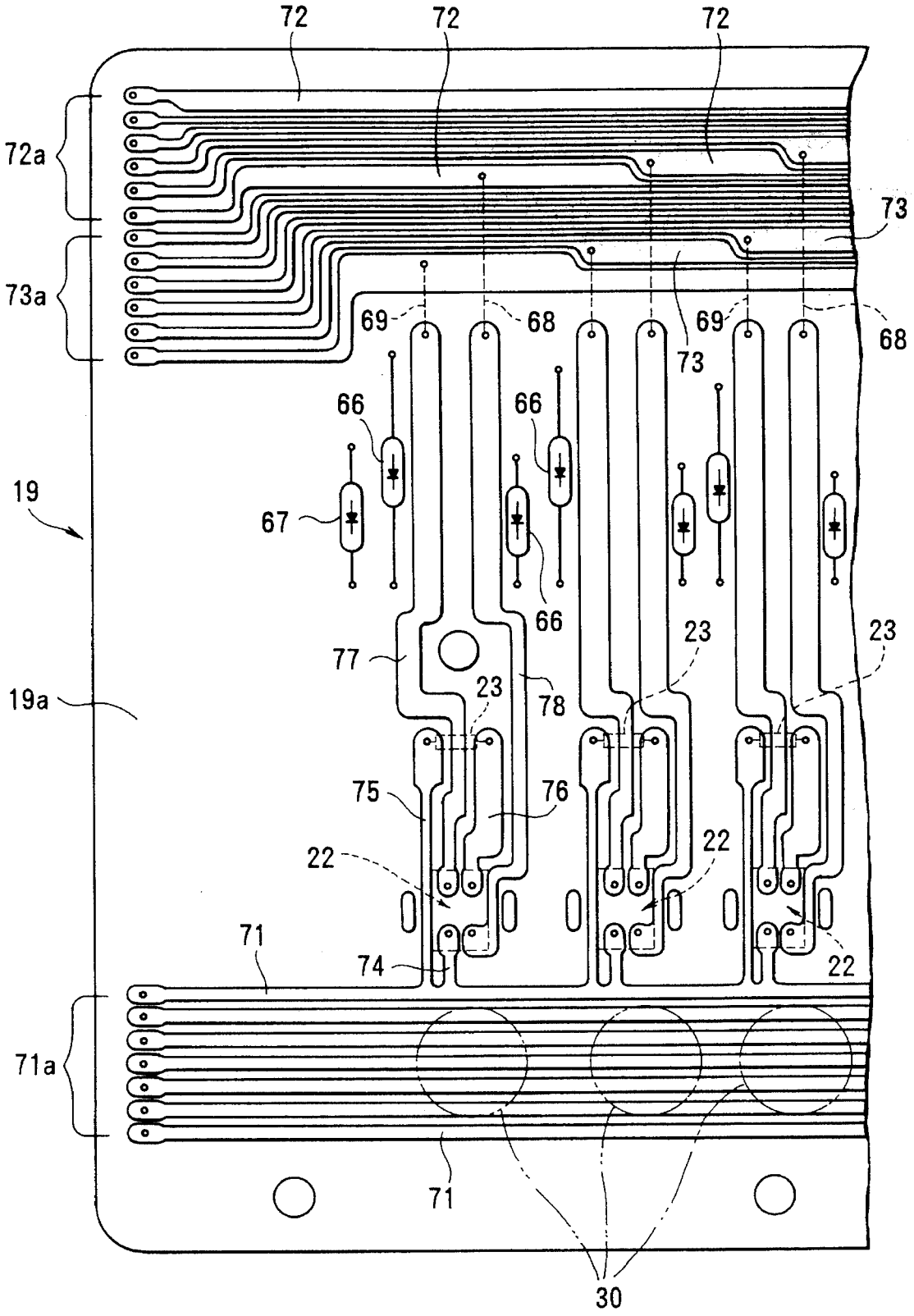
FIG. 8 is a bottom view of the right end portion of the printed circuit board when the printed circuit board is turned upside down and then turned over.

FIG. 6 shows a circuit diagram of one touch response switch on the printed circuit board, FIG. 7 shows the right end portion (i.e., a highest treble portion) of the printed circuit board, and FIG. 8 shows the same portion located upside down and turned over.

Referring to FIG. 7, a stationary contact group of the touch response switch 30 corresponding to each key is formed along the direction of the array of the keys near the front side (lower side in FIG. 7) of the upper surface of an insulating board 19*a*.

Each stationary contact group consists of a pair of contact patterns 35*a* and 35*b* constituting the first stationary contacts 35, a pair of contact patterns 36*a* and 36*b* constituting the first stationary contacts 36, and a pair of contact patterns 37*a* and 37*b* constituting the second stationary contacts 37. The contact patterns 35*a*, 36*a*, and 37*b* are formed as U-shaped patterns, and the contact patterns 35*b*, 36*b*, and 37*a* are formed as E-shaped patterns, so that these different patterns are interdigitally arranged.

These contact patterns are exposed from an insulating layer having a resist pattern except for the lands after carbon is formed on a copper film of the circuit board as in other conductive patterns.

The contact patterns 35*a* and 35*b* of the first stationary contacts 35, the contact patterns 36*a* and 36*b* of the first stationary contacts 36, and the contact patterns 37*a* and 37*b* of the second stationary contacts 37 are rendered conductive when the first movable contact 32, the first movable contact 33, and the second movable contact 34 shown in FIG. 5 are brought onto the above pairs, respectively.

That is, these contacts constitute the first make switches S1*a* and S1*b*, and the second make switch S2, shown in FIG. 6.

The contact patterns 35*a* and 36*a* are connected by a conductive pattern 38*a* and are guided by a conductive pattern 61 to a land portion 61*a* formed at an upper intermediate portion along the direction of the width of the insulting board 19*a*.

The contact pattern 37*a* is guided to a land portion 62*a* by a conductive pattern 62 formed parallel to the conductive pattern 61.

The contact patterns 35*b*, 36*b*, and 37*b* are respectively connected to conductive patterns 38*a*, 38*b*, and 38*c* and are guided by common conductive patterns 63 to a land portion 63*a* serving as a common terminal formed near the side edge of the insulating board 19*a*.

The conductive patterns 63 comprises seven conductive patterns along the longitudinal direction of the insulating board 19*a*. Each conductive pattern 63 connects six (six keys) touch response switches 20.

Six stationary contact patterns parallel to the stationary contact patterns 35, 36, and 37 shown in FIG. 7 are commonly connected to the third land portion 63*a* from the top, and the next six stationary contact patterns correspond to the second land pattern 63*a*. In this manner, the contact patterns of the touch response switches 30 corresponding to 42 (6×7) keys are formed.

A plurality of these boards are prepared for an electronic musical instrument having a larger number of keys. As for a board for the contact patterns corresponding to five or less keys, another board having the above structure or a board including an extra number of contact patterns corresponding to five or less keys is prepared.

As shown in FIG. 7, a large number of conductive patterns (six each in the illustrated arrangement) 64 and 65 are formed from the intermediate portion of the direction of the width of the insulating board 19*a* upward along the longitudinal direction. Land portions 64*a* serving as first make switch terminals and land portions 65*a* serving as second make switch terminals are formed near the side edge of the board 19*a*.

Lead wires of both ends of diodes 66 are inserted into small holes formed in the land portions 61*a* and the wide portions of the corresponding conductive patterns 64 from the lower surface of the insulating board 19*a* and are soldered therewith, so that the land portions 61*a* are electrically connected to the conductive patterns 64 through the corresponding diodes 66.

Similarly, lead wires of both ends of diodes 67 are inserted into small holes formed in the land portions 62*a* and the wide portions of the corresponding conductive patterns 65 from the lower surface of the insulating board 19*a*, so that the land portions 62*a* are connected to the conductive patterns 65 through the corresponding diodes 67.

As described above, one-key stationary contact groups in units of six keys for the touch response switches 30 are connected to the conductive patterns 64 and 65 through the corresponding diodes 66 and 67 in a predetermined order.

The one-key touch response switches 30 are connected on the printed circuit board 19, as shown in FIG. 6 and are scanned by a microcomputer (to be described later), so that a key-on speed is detected in accordance with a difference between an ON timing of the first make switch S1*a* or S1*b* and an ON timing of the second make switch S2.

Since the two switches S1*a* and S1*b* as the first make switches are arranged parallel to each other at a predetermined gap in the longitudinal direction and are connected in parallel with each other. When one of the switches is turned on during key depression, the ON state of the first make switch is determined. The ON timing of the first make switch can be properly detected in the initial period of key depression regardless of the inclination of the movable projection 31.

A resist film is formed on the insulating board 19*a* and the respective conductive patterns except for the contact patterns 35*a*, 35*b*, 36*a*, 36*b*, 37*a*, and 37*b*, the land portions 61*a*, 62*a*, 63*a*, 64*a*, and 65*a*, and the small holes formed in the wide portions of the conductive patterns 64 and 65.

Reference numerals 22 denote photointerrupters of stroke sensors 20. Each photointerrupter 22 comprises a light-emitting diode (LED) 22*a* and a phototransistor 22*b*. Four pins of the photointerrupter 22 are inserted into four small holes formed in the insulating board 19*a* and are soldered with conductive patterns (to be described later) formed on the lower surface, respectively.

Reference numerals 23 denote resistors inserted between the LEDs 22*a* of the photointerrupters and a power supply circuit. Lead wires of each resistor 23 are inserted into two small holes formed in the insulating board 19*a* and are soldered with the conductive pattern (to be described later) of the lower surface.

Reference numerals 68 and reference numerals 69 denote jumper wires. Both ends of each jumper wire 68 or 69 are inserted into small holes of the insulating board 19*a* to connect remote conductive patterns.

The lower surface of the printed circuit board 19 in FIG. 8 will be described below.

On the lower surface of the insulating board 19*a*, a large number (seven in this embodiment) of parallel power supply conductive patterns 71 are formed on the front side (lower side in FIG. 8) together with land portions 71*a* along the longitudinal direction.

The touch response switches 30 are arranged on the lower side of the conductive patterns 71, i.e., the upper surface in front (lower side) of the photointerrupters 22, in correspondence with the conductive patterns 71.

A large number (six in this embodiment) of parallel phototransistor (PT) scan conductive patterns 72 and a large number (six in this embodiment) of parallel LED scan conductive patterns 73 are formed behind (upper side) the conductive patterns 71 with land portions 72*a* serving as PT scan terminals and land portions 73*a* serving as LED scan terminals at side edge of the insulating board 19*a* along the longitudinal direction.

In addition, conductive patterns 74 to 78 for the photointerrupters 22 are formed almost parallel to each other between the conductive patterns 71 and 73 along the direction of the width of the insulating board 19*a* at predetermined intervals along the longitudinal direction.

The conductive patterns 74 and 75 are branched from the power source conductive patterns 71. Each pin of each photointerrupter 22 inserted from the upper surface into the corresponding small hole of the land formed at one end of each of the conductive patterns 74, 76, 77, and 78 extends and is soldered. The distal end of each lead wire of each resistor 23 inserted from the upper surface to the corresponding small hole formed in the land portion at the other end of each of the conductive patterns 76 extends and is soldered.

A power is supplied from the power supply conductive patterns 71 to the phototransistors 22*b* (FIG. 7) of the photointerrupters 22 through the conductive patterns 74 and to the LEDs 22*a* (FIG. 7) through resistors 23 arranged between the conductive patterns 75 and 76.

The cathodes of the LEDs 22*a* of the photointerrupters 22 are connected to the corresponding LED scan conductive patterns through the conductive patterns 77 and the upper jumper wires 69. The emitters of the phototransistors 22*b* are connected to the corresponding PT scan conductive patterns 72 through the conductive patterns 78 and the upper jumper wires 68.

The conductive patterns 74 and 75 each supplying a power to a set of six photointerrupters 22 are branched from each of the power supply conductive patterns 71. The conductive patterns 77 and 78 for the photosensors 22 each for a set of six photosensors 22 are connected to the scan conductive patterns 72 and 73 through the jumper wires 69 and 68, respectively.

The diodes 66 and 67 are used for the touch response switches 30.

A resist film is formed on the entire lower surface of the insulating board 19*a* except for the land portions (i.e., portions around the small holes) of the conductive patterns 71 to 78.

A large number of land portions 63*a* to 65*a* serving as terminals of the touch response switches 30 and a large number of land portions 71*a* to 73*a* serving as terminals of the stroke sensors 20 are formed on side edge portions of the upper and lower surfaces of the printed circuit board 19 at positions where the land portions 63*a* to 65*a* do not overlap the land portions 71*a* to 73*a*. When connectors (not shown) are connected to these land portions, the land portions 63*a* to 65*a* on the upper surface are connected to the bus lines of a microcomputer (to be described later) through contact terminals and connection cables, and the land portions 71*a* to 73*a* on the lower surface are connected to a stroke sensor scan circuit (to be described later).

The conductive patterns on the upper surface of the printed circuit board 19 are perfectly independent of the conductive patterns on the lower surface thereof and are not electrically connected to the conductive patterns on the lower surface through via holes.

As described above, when the printed circuit for the touch response switches and the printed circuit for the stroke sensors are independently formed on the upper and lower surfaces of the printed circuit board, respectively, and the these circuits are connected to an external circuit through common connectors, wiring can be simplified, and assembly, maintenance, and inspection can be facilitated.

In this embodiment, the printed circuit board 19 having various patterns on the upper and lower surfaces on the insulating board 19*a* is used as a 42-key board. More specifically, a treble 42-key board (right board, as shown in FIGS. 7 and 8) and a bass 42-key board (left board) are combined with a lowest bass 4-key board to constitute an 88-key printed circuit board arrangement.

The printed patterns of the right and left printed circuit boards 19 are symmetrical with each other, so that layout design of the printed patterns can be halved, and a common photoetching reticle can be reversely used.

It is possible to form circuit patterns of the stroke sensors 20 and the touch response sensors 30 by only a pair of right and left symmetrical printed circuit boards, depending on the number of keys of the keyboard and keyboard design.

After Sensor Unit

The after sensor unit will be described in detail with reference to FIGS. 9 to 12.

Figure 9:
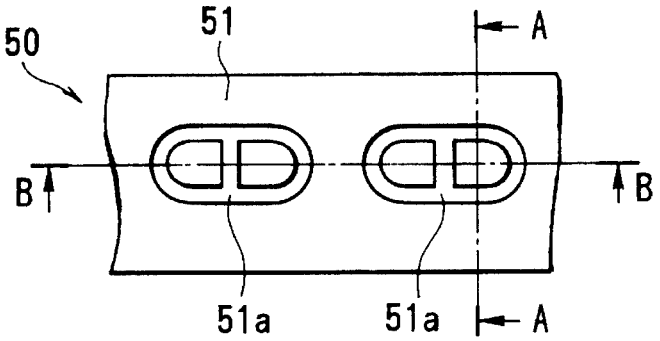
FIG. 9 is an enlarged plan view showing an after sensor unit portion corresponding to two white keys.
Figure 10:
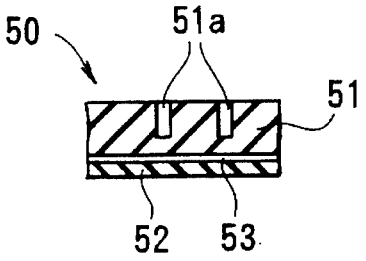
FIG. 10 is a sectional view of the after sensor unit portion along the line A—A in FIG. 9.
Figure 11:
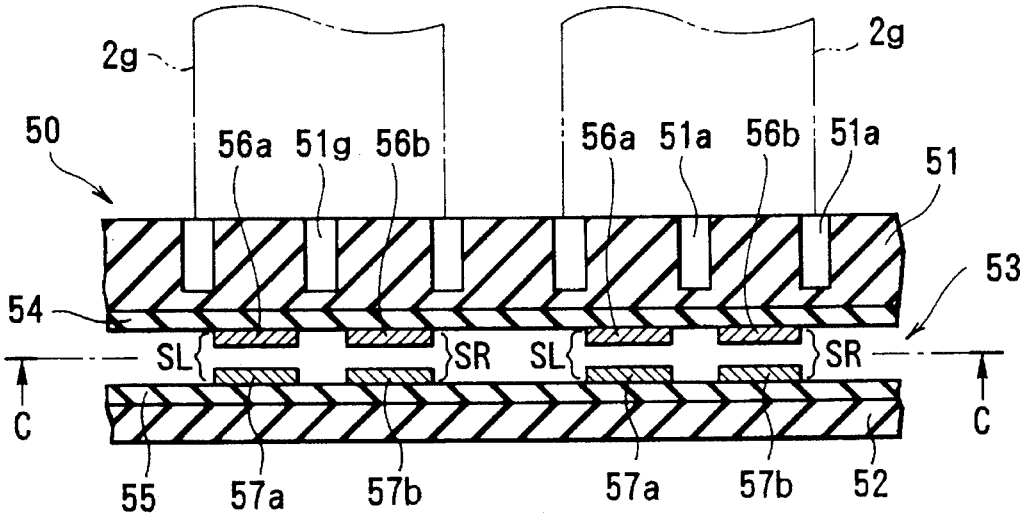
FIG. 11 is an enlarged sectional view of the after sensor unit portion along the line B—B of FIG. 9 when the sensor unit is separated into upper and lower sensor portions.
Figure 12:
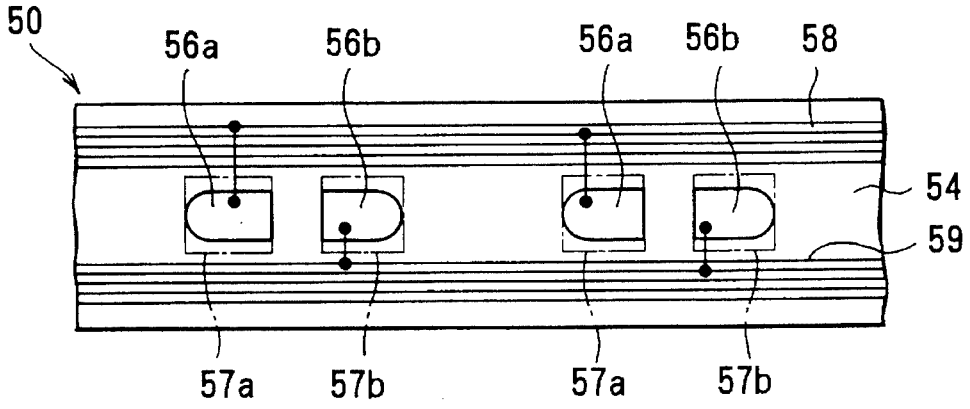
FIG. 12 is a bottom view of the upper sensor portion along the line C—C of FIG. 11 viewed from a direction indicated by an arrow.

FIG. 9 shows a portion of the after sensor unit (FIGS. 1 and 3) which corresponds to two white keys 2. FIG. 10 shows a section of the portion of FIG. 9 along the line A—A. FIG. 11 shows a section of the sensor portion which is divided into upper and lower parts. FIG. 12 shows the upper portion along the line C—C of FIG. 11.

The after sensor unit 50 is elongated in correspondence with all 88 keys. As shown in FIG. 10, a sensor portion 53 is sandwiched between a base 52 made of an insulating plate and the silicone rubber pad 51. As shown in FIG. 9, a groove 51*a* obtained by dividing an elongated hole into two parts, as shown in FIG. 9, is formed on the upper surface of the silicone rubber pad 51.

As shown in FIG. 11, in the sensor portion 53, insulating film substrates 54 and 55 are adhered to the lower and upper surfaces of the silicone rubber pad 51 and the base 52, respectively. A pair of symmetrical semicircular pressure-sensitive ink contacts 56*a* and 56*b* are printed at positions surrounded by the groove 51*a* formed on the lower surface of the film substrate 54. A pair of rectangular carbon contacts 57*a* and 57*b* are formed on the film substrate 55 at positions opposite to those of the pressure-sensitive ink contacts 56*a* and 56*b*.

Conductive films are preferably formed on the surfaces of the film substrates 54 and 55 at positions corresponding to the pressure-sensitive ink contacts 56*a* and 56*b* and the carbon contacts 57*a* and 57*b*.

The pair of pressure-sensitive contacts 56*a* and 56*b* and the opposite carbon contacts 57*a* and 57*b* are clamped so as to contact each other to constitute a pair of analog sensors serving as after sensors SL and SR corresponding to one key. At the last period of key depression or upon key depression, when the silicone rubber pad 51 is depressed by the actuator 2*g*, indicated by the alternate long and two short dashed line in FIG. 11, of the white key 2, the pressure-sensitive ink contacts 56*a* and 56*b* are charged in accordance with the pressure applied from the actuator 2*g*, thereby decreasing their resistances.

Each of the pressure-sensitive ink contacts 56*a* and 56*b* is connected to any one of conductive patterns 58 and 59 each consisting of five parallel patterns along the longitudinal direction on the film substrate 54, as shown in FIG. 12. Similarly, each of the carbon contacts 57*a* and 57*b* is connected to any one of 18 conductive patterns (not shown) formed parallel to each other on the film substrate 55 along its longitudinal direction.

When the conductive patterns 57*a* and 57*b* and the conductive patterns (not shown) formed on the film substrate 55 are connected to a scan circuit (to be described later) through connectors mounted at both end portions of the after sensor unit. Changes in resistances of the paired after sensors SL and SR which correspond to a depression force of the actuator 2*g* by the after touch at the end of key depression or upon key depression can be detected as analog signals.

The sensor portion for the black key 3 has the same arrangement as that of the white key except that the sensor portion of the black key 3 is slightly shifted backward from that of the sensor portion of the white key (FIG. 3), so that the sensor portion for the black key 3 can be properly depressed by the actuator 3*g* at the front end portion of the black key 3.

The pair of right and left analog sensors serving as the after sensors corresponding to each key are arranged in the direction of the width of the key to detect a difference between the right and left depression forces generated such that a finger is vibrated laterally while depressing the key. However, three or more analog sensors may be arranged for each key to detect differences in depression forces in the back-and-forth (longitudinal) direction, oblique directions, and the like of the key, thereby providing more complicated musical tone control which appropriately reflects the will of a performer.

In the above embodiment, the paired after sensors SL and SR of the after sensor unit 50 are analog sensors whose resistances are continuously changed. However, each after sensor may be a sensor (digital sensor) for outputting multi-step data, each bit of which is set at logic "0" or "1".

The above after sensor may comprise a digital sensor of a digital switch type for directly outputting a plurality of bits corresponding to a contact count value of the electrodes against the depression forces, or a digital sensor for converting a contact count value of the electrodes against the depression forces into digital values each having a plurality of bits through a converter.

Figure 37A:
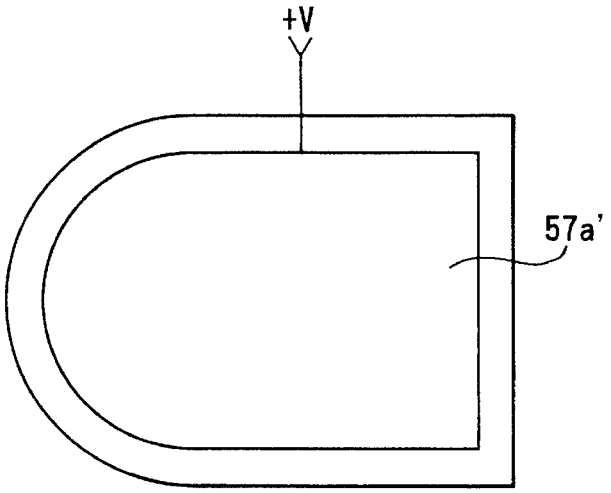
FIGS. 37A and 37B are enlarged exploded plan views showing an arrangement of a digital after sensor.
Figure 37B:
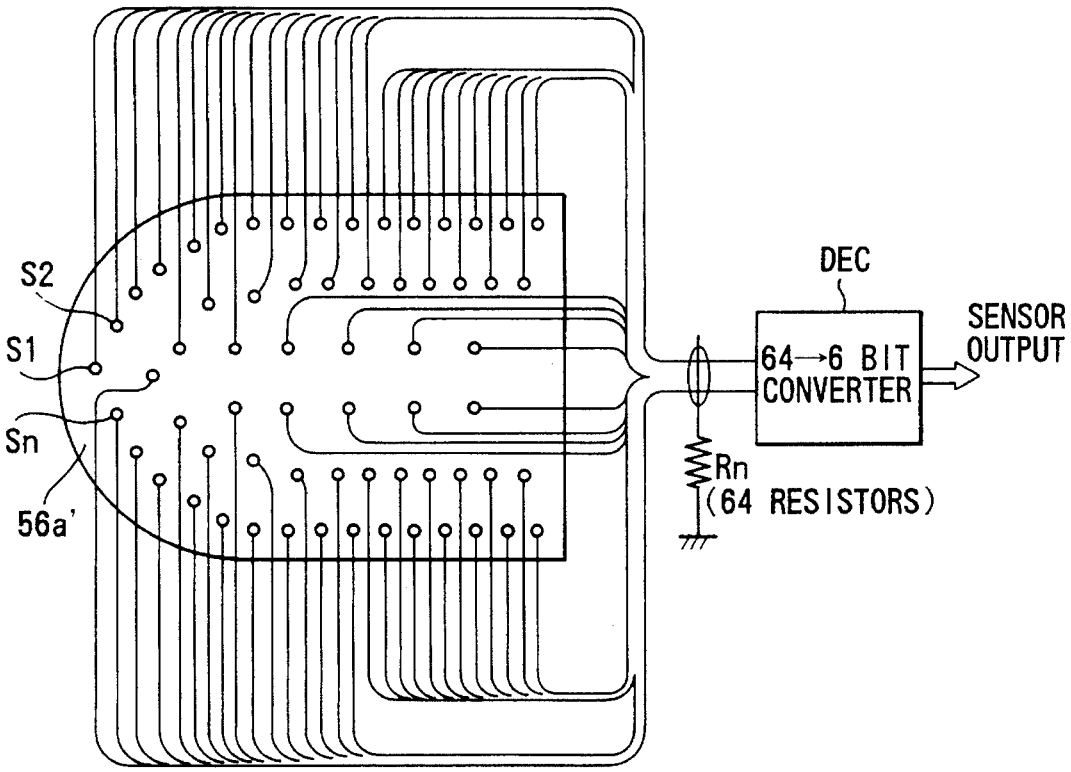

FIGS. 37A and 37B exemplify the latter digital sensor.

As shown in FIG. 37A, this digital sensor is arranged such that pairs of uniform electrodes 57*a*' are formed on the lower surface of a film substrate on a press member side such as the silicone rubber pad 51, and a voltage of +V (or −V) is applied to each electrode 57*a*'.

As shown in FIG. 37B, pairs of sensing patterns 56*a*' (each pair is arranged for each key) each having a large number (64 in this case) of micropatterned electrodes S1 to Sn are formed on the upper surface of the film substrate on the base 52 side so as to oppose the electrodes 57*a*'.

In the illustrated state, each electrode 57*a*' is turned over and placed on the corresponding sensing pattern 56*a*' and is brought into tight contact therewith.

The micropatterned electrodes S1 to Sn of the sensing pattern 56*a*' are obtained by applying a pressure-sensitive ink to a conductor (Cu) and are formed in accordance with techniques disclosed in Japanese Patent Laid-Open Nos. 56-108279 and 62-116230. In a nonpressurized state, each electrode has a high resistance. In a pressurized state, each electrode has a low resistance. In this manner, the electrode is not substantially set to an intermediate resistance between the high and low resistances, thereby providing switching characteristics.

Output lines from the micropatterned electrodes S1 to Sn are grounded through resistors Rn, respectively. A 64-bit output obtained by setting the voltage level of each resistor terminal to be low level "0" or high level "1" is converted into a 6-bit binary signal by a converter DEC. This 6-bit signal serves as a sensor output and is inputted to a digital processing circuit or a microcomputer.

System Configuration of Embodiment

The overall system configuration of the electronic keyboard musical instrument according to this embodiment will be described with reference to FIG. 13.

A keyboard 25 of this electronic musical instrument comprise a contact sensor group 24 (corresponding to plated portions of the respective keys) formed by the keys 2 and 3 (88 keys in this embodiment) having metal-plated surfaces, a stroke sensor group 20G consisting of 88 stroke sensors 20 arranged in correspondence with all the keys, a touch response switch group 30G consisting of 88 2-make touch response switches 30 (contact time difference switches) as in the stroke sensor group 20G, and the after sensor unit 50 constituted by the pairs of after sensors SL and SR, each pair of which corresponds to each key.

A switch group 91 including a large number of switches such as a tone color selection switch, a rhythm selection switch, an effect selection switch, and a volume control switch is also arranged on an operation panel (not shown).

A microcomputer 80 controls the overall operation of this electronic musical instrument. The microcomputer 80 comprises a known CPU (Central Processing Unit) 81, a ROM 82 serving as a program memory, a RAM 83 serving as a working memory, and a bus 85 consisting of an address bus, a data bus, and a control bus. The bus 85 is connected to the CPU 81, the ROM 82, and the RAM 83 and is also connected to input/output ports (not shown). In this embodiment, the microcomputer 80 also includes a timer circuit 84 for generating three different interrupt signals $T_1$, $T_2$, and $T_3$ to interrupt the CPU 81.

The input of the microcomputer 80 is connected to the contact sensor group 24 through a contact detector 86, to the stroke sensor group 20G through a scan circuit 87 and an output circuit 88, to the touch response switch group 30G directly, to the after sensor unit 50 through a scan circuit 89 and an operational amplifier circuit 90, and to the switches 91 of the operation panel through a scan circuit 92. The output of the microcomputer 80 is connected to a sound source circuit 93, and a sound unit 94 is connected to the sound source circuit 93.

The contact detector 86 monitors each key serving as a sensor of the contact sensor group 24, detects a touch with a finger of a performer, and sends a detection signal to the microcomputer 80.

The scan circuit 87 causes a matrix circuit to sequentially scan the stroke sensors 20 of the stroke sensor group 20G. The scan circuit 87 detects an analog displacement of each key during key depression and sends a detection signal to the microcomputer 80 through the output circuit 88.

The touch response switch group 30G is directly scanned by the microcomputer 80, and the microcomputer 80 always monitors the ON/OFF states of the first and second make switches of each touch response switch 30.

The scan circuit 89 causes a matrix circuit to sequentially scan the left and right after sensors SL and SR, corresponding to each key, of the after sensor unit 50. The scan circuit 89 detects an analog signal corresponding to each resistance value. Output signals from the left and right after sensors are amplified or calculated to obtain a difference value or a sum value by the operational amplifier circuit 90. An output from the operational amplifier circuit 90 is supplied to the microcomputer 80.

The scan circuit 92 sequentially scans the switch group 91 on the operation panel and sends detection signals representing the operating states of the respective switches to the microcomputer 80.

The sound source circuit 93 includes a musical tone signal generator or a digital musical tone signal generator constituted by a sound source oscillator and a frequency divider, a switching circuit, various modulators, a tone color filter circuit, an envelope forming circuit, and various effect circuits. The sound source circuit 93 generates a musical tone having a pitch corresponding to a key code of a key whose depression is determined by a detection signal from the contact detector 86 (a polyphonic tone can be produced). Various control operations such as modulation, tone color formation, envelope formation, and effect additions are performed for the generated musical tone signals in accordance with detection signals from the respective switches and sensors. The processed musical tone signal is outputted to the sound system 94.

The sound system 94 includes an amplifier and loudspeakers. The sound system 94 amplifies the musical tone signal inputted from the sound source circuit 93, and the input tone signal is electroacoustically converted by the loudspeakers and is produced as a musical tone.

Contact Detector

A detailed arrangement of the contact detector 86 will be described with reference to FIGS. 14 and 15.

Figure 14:
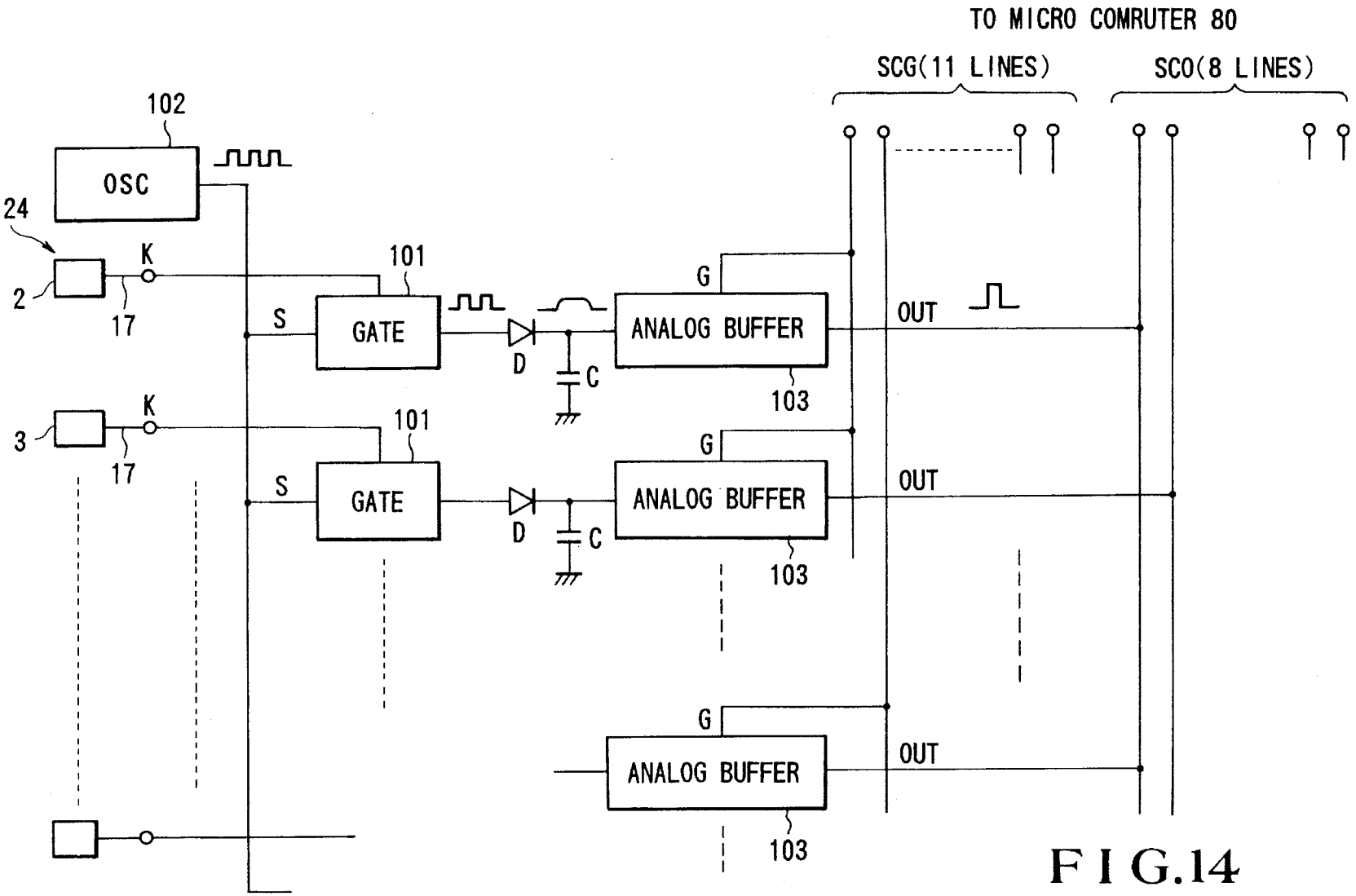
FIG. 14 is a diagram showing a detailed arrangement of a contact detector in FIG. 13.

The contact detector shown in FIG. 14 comprises 88 gate circuits 101 having input terminals K respectively connected to the lead wires 17 (FIGS. 1 and 2) from the keys 2 and 3 constituting the respective contact sensors. A pulse signal having a predetermined period and always outputted from an oscillator (OSC) 102 is inputted to an input terminal S of each of the gate circuits 101.

Figure 15:
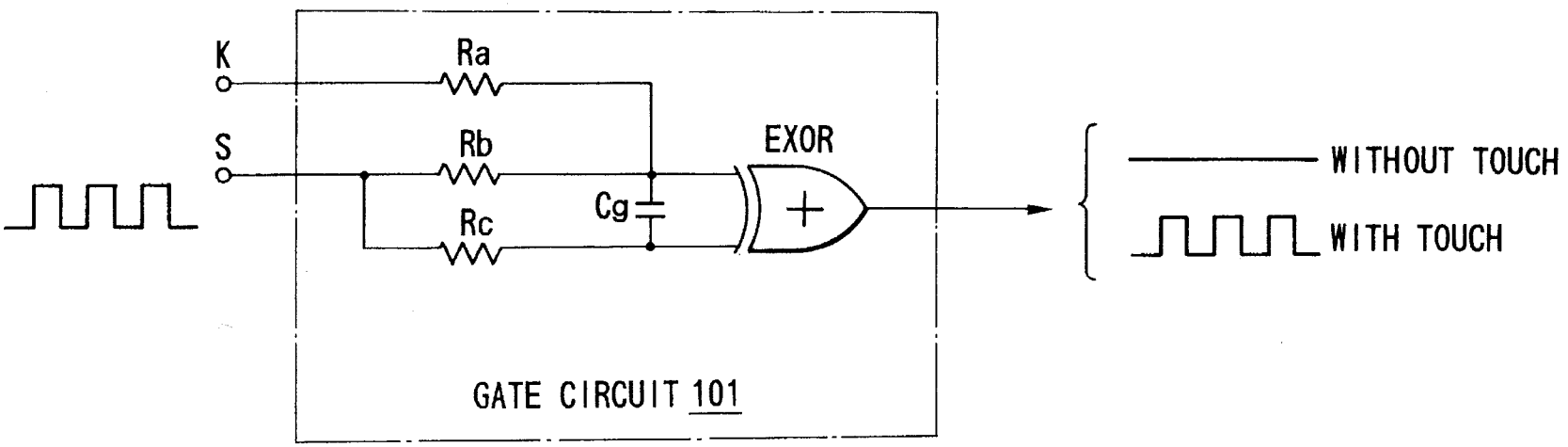
FIG. 15 is a circuit diagram of a gate circuit 101 in FIG. 14.

As shown in FIG. 15, each gate circuit 101 comprises an exclusive OR circuit EXOR, its input resistors Ra, Rb, and Rc, and a capacitor Cg.

Since the input terminal K of each gate circuit 101 is normally set in a floating state (i.e., in a state wherein a key is not touched), inputs to the exclusive OR circuit are always simultaneously "0" or "1" due to a pulse signal from the input terminal S. Therefore, the output from the exclusive OR circuit EXOR is always "0".

When a key is touched by a performer, the metal-plated surface of the key is grounded through the body of the performer, and then the input terminal K is set at level "0". When the other input is set at logic "1" by the pulse signal, an EXOR output is set at logic "1". Therefore, this gate circuit 101 outputs a pulse signal having the same waveform as that of the input pulse signal.

The output signal from each gate circuit 101 is rectified and smoothed by a diode D and a capacitor C. The smoothed output is outputted through a corresponding analog buffer 103. An output from the analog buffer 103 is scanned and fetched by the microcomputer 80 shown in FIG. 13.

Eleven scan lines SCG from the microcomputer 80 are commonly connected to the gate terminals of the analog buffers 103 constituting groups each corresponding to eight keys. The output terminals of the analog buffers 103 of each group are connected to eight scan lines SCO from the microcomputer 80.

The microcomputer 80 sequentially sets the eleven scan lines SCG to "1" every predetermined period Tg, so that the analog buffers 103 are sequentially enabled in units of groups each consisting of eight analog buffers. Within this predetermined period, the eight scan lines SCO are sequentially enabled every predetermined period To ($To \leqq Tg/8$). The microcomputer 80 sequentially fetches pulses from the analog buffers 103, if any.

The output signals from the analog buffers 103 are sequentially fetched by the microcomputer 80 within a specific time slot. Therefore, a plurality of output signals are simultaneously fetched by the microcomputer 80.

Signal Detection of Stroke Sensor Group

Details of the stroke sensor group 20G, the scan circuit 87, and the output circuit 88 in FIG. 13 will be described in detail with reference to FIGS. 16 to 19.

Figure 16:
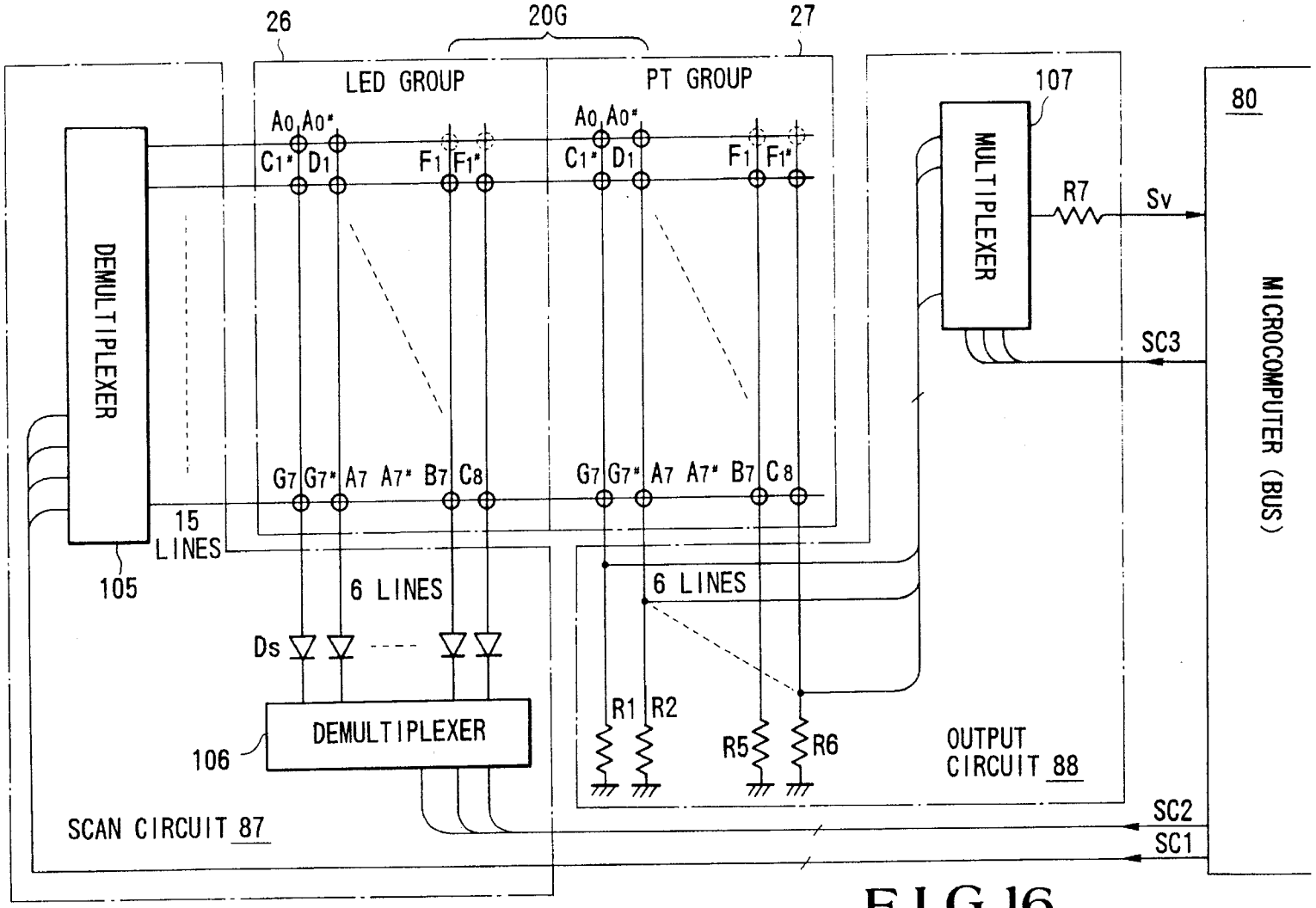
FIG. 16 is a block diagram showing a detailed arrangement of a stroke sensor group 20G, a scan circuit 87, and an output circuit 88 in FIG. 13.
Figure 17:
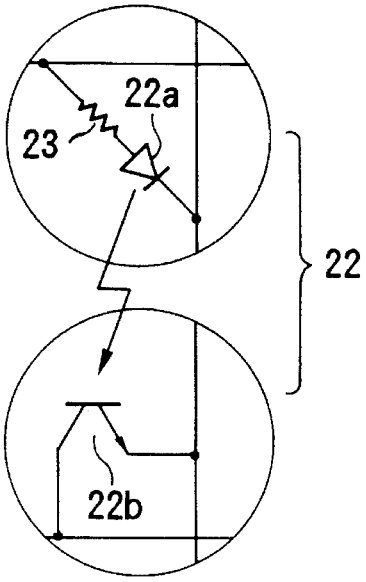
FIG. 17 is a view for explaining a connecting state of a stroke sensor to a matrix circuit.

FIG. 16 shows the circuit arrangement of the stroke sensor group 20G, the scan circuit 87, and the output circuit 88. In the stroke sensor group 20G, the photointerrupters 22 and the resistors 23 (FIG. 7) constituting the stroke sensors 20 are divided into an LED group 26 and a PT group 27. The LED group 26 is obtained by connecting series circuits of the LEDs 22*a* and the resistors 23 in a matrix form, as shown in FIG. 17. The PT group 27 is obtained by connecting the phototransistors 22*b* in a matrix form, as shown in FIG. 17. Fifteen horizontal lines (power source lines) of each group are commonly connected.

The common horizontal lines of the LED and PT groups 26 and 27 are connected to the output terminals of a demultiplexer 105, respectively. Six vertical lines of the LED group 26 are respectively connected to output terminals of a demultiplexer 106 of the scan circuit 87 through corresponding diodes Ds.

Six vertical lines of the PT group 27 are grounded through output resistors R1, R2, . . . , R6 of the output circuits, and are connected to the input terminals of a multiplexer 107, respectively.

The demultiplexers 105 and 106 and the multiplexer 107 are controlled in accordance with scan control signals SC1, SC2, and SC3 counted up by bits of the microcomputer 80 as a function of time. The demultiplexer 105 sequentially shifts a voltage (FIG. 18A) of high level having a predetermined pulse width by its pulse width and applies the shifted voltages to the 15 horizontal lines at different timings corresponding to the predetermined pulse widths.

Figure 18A:
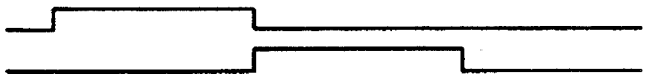
FIGS. 18A and 18B are waveform charts showing two different scan signals, respectively.
Figure 18B:
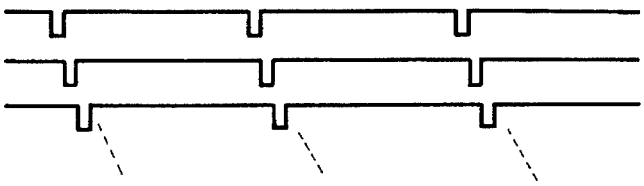

The demultiplexer 106 sequentially shifts a pulse signal of low level having a small pulse width (i.e., ⅙ or less of the above pulse width), as shown in FIG. 18B, by the small pulse width, and applies the shifted pulse signals to the six vertical lines of the LED group 26. Therefore, the six LEDs 22*a*, the anodes of which are connected to the common horizontal lines through the resistors 23, are sequentially set at low level and turned on.

The multiplexer 107 selects and outputs output signal pulses to lines which correspond to the lines set to low level by the demultiplexer 106 and which are selected from the six vertical lines of the PT group 27. The output signal pulses are fetched as a stroke detection signal Sv to the microcomputer 80 through a resistor R7.

When the LED 22*a* constituting the photointerrupter 22 (FIG. 17) of a given stroke sensor 20 is turned on by the scan circuit 87, its emission light is reflected by the smooth surface 21*d* of the movable projection 21 shown in FIG. 5 and is received by the corresponding photodiode 22*b*. A photocurrent corresponding to the amount of reception light flows through a corresponding resistor (any one of the resistors R1 to R6 having the same resistance) of the output circuit. A voltage is then generated across this resistor.

This voltage is an analog signal corresponding to the depth or stroke of the depressed key. The voltage signal is sensed by the multiplexer 107, and the sensed signals are sequentially outputted.

Figure 19:
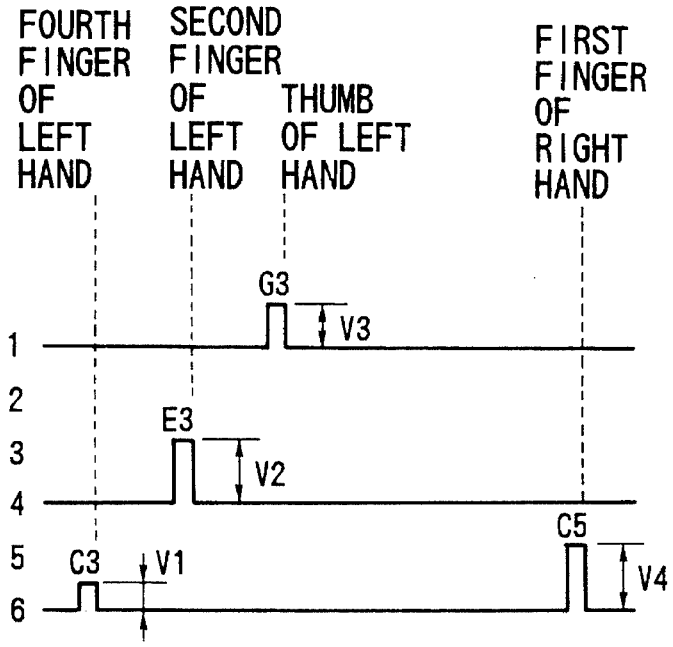
FIG. 19 is a view for explaining stroke sensor outputs at given timings.

For example, when a performer depresses the $C_3$ key with the fourth finger of the left hand, the $E_3$ key with the second finger of the left hand, the $G_3$ key with the thumb of the left hand, and the $C_5$ key with the first finger of the right hand at given timings, the microcomputer 80 receives stroke detection signals V1, V2, V3, and V4 having different levels corresponding to the depths of the depressed keys at the timings shown in FIG. 19.

Signal Detection of Touch Response Switch Group

Figure 13:
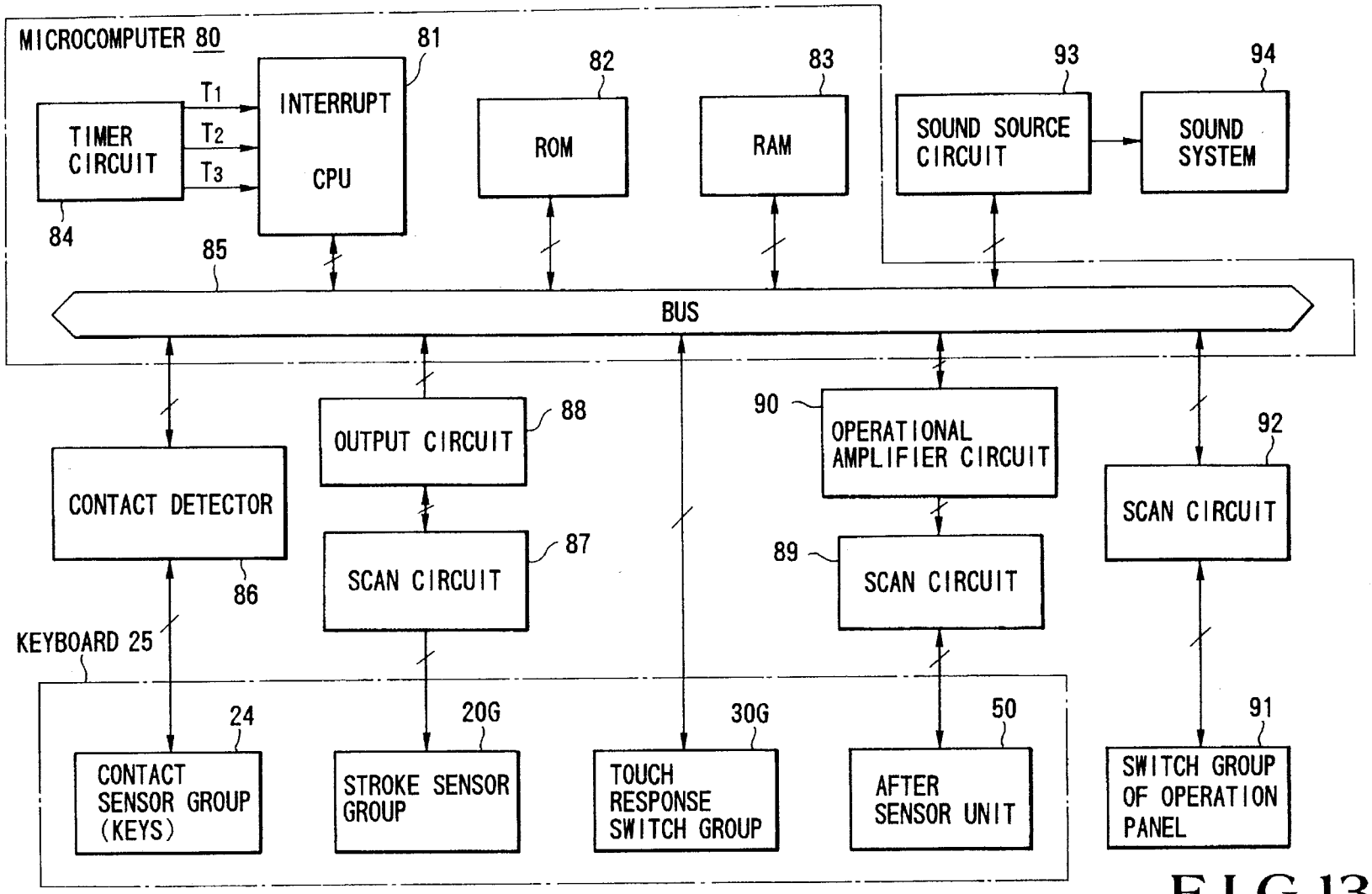
FIG. 13 is a block diagram showing a system of the electronic keyboard musical instrument of this embodiment.
Figure 20:
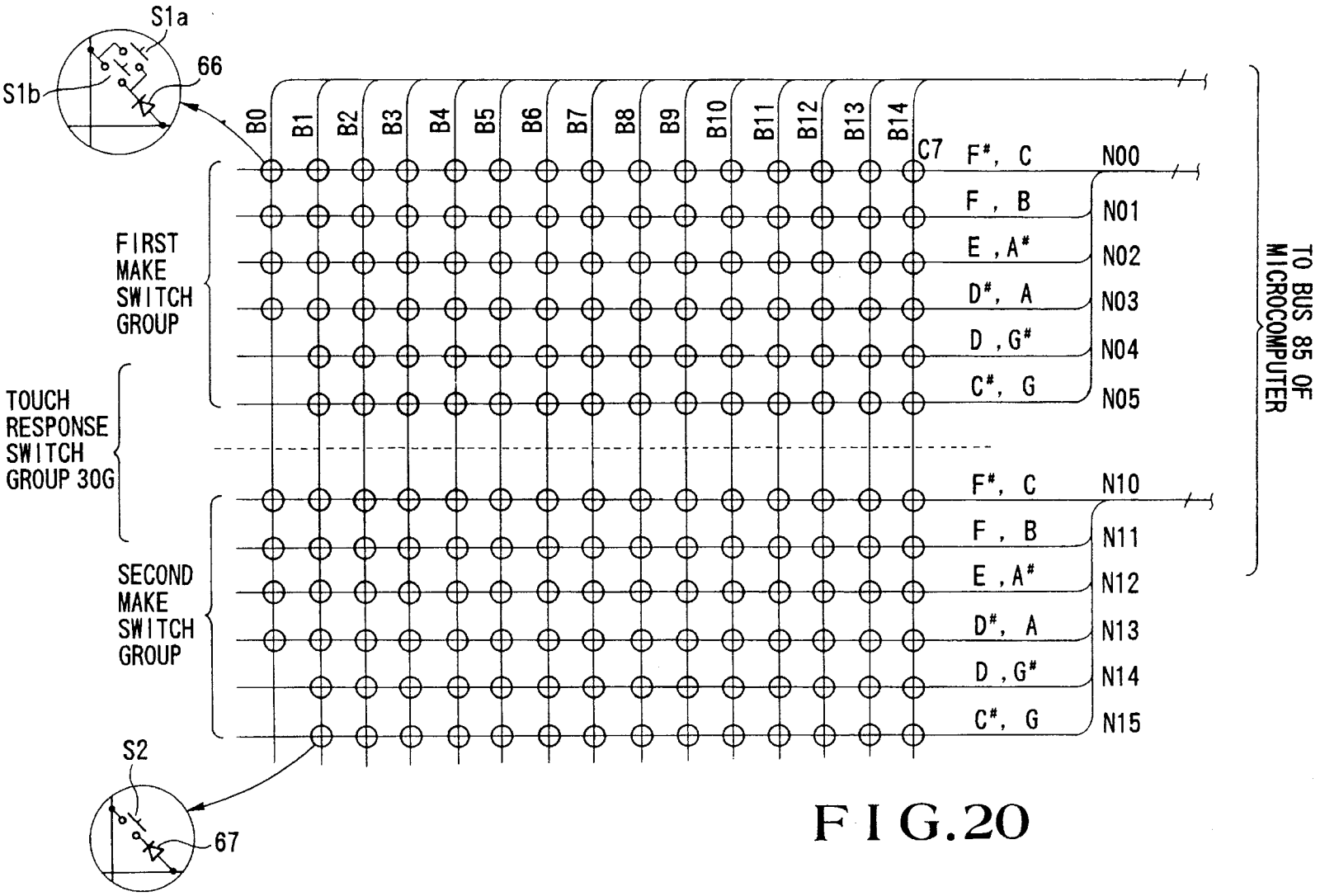
FIG. 20 is a diagram showing a scan matrix circuit of a touch response switch group 30G under the control of a microcomputer 80 in FIG. 13.

A scan matrix circuit of the touch response switch group 30G in FIG. 13 by the microcomputer 80 is shown in FIG. 20.

The touch response switches 30 arranged in correspondence with the 88 keys 2 and 3 and constituting the touch response switch group 30G are classified into a first make switch group and a second make switch group to constitute the matrix circuit. The first make switch group consists of series circuits of the diodes 66 and parallel circuits each consisting of the first make switches S1*a* and S1*b* (the enlarged view in the upper circle in FIG. 20 and the arrangements in FIGS. 6 to 8). The second make switch group consists of series circuits each consisting of the second make switch S2 and the diode 67 (the enlarged view in the lower circle in FIG. 20 and the arrangements in FIGS. 6 to 8).

More specifically, as indicated by the enlarged views of the upper and lower circles of the intersections of the matrix circuit constituted by 15 vertical scan lines B0 to B14 and horizontal scan lines N00 to N05 and N10 to N15, the first make switches S1*a* and S1*b* of each touch response switch 30 is connected in series with the corresponding diode 66, and the second make switch S2 is also connected in series with the corresponding diode 67.

Since this matrix circuit is directly scanned by the microcomputer 80, signals having the same predetermined pulse width as in FIG. 18A but shifted by this pulse width are sequentially applied from the microcomputer 80 to the vertical canning lines B0 to B14. Signals having the same short pulse width (i.e., ⅙ of the pulse width of each signal applied to the vertical scanning lines B0 to B14) as shown in FIG. 18B but shifted by this short pulse width are sequentially applied to the horizontal scan lines N00 to N05. The detected levels are then fetched by the microcomputer 80.

At this time, when the first make switch S1*a* or S1*b* is kept closed, a signal of high level is detected.

The shifted signals having the predetermined pulse width are sequentially applied to the vertical scan lines B0 to B14 again. Similarly, the shifted signals having the short pulse width are sequentially applied to the horizontal scan lines N10 to N15. The detected levels are then fetched by the microcomputer 80.

At this time, when the second make switch S2 is kept closed, a signal of high level is detected.

As described above, the microcomputer 80 independently scans the first make switch group for the first time and the second make switch group for the second time.

Signal Detection of After Sensor Unit

The scan circuit and the operational amplifier for detecting signals from the left and right after sensors SL and SR corresponding to each key in the after sensor unit 50 in FIG. 13 will be described with reference to FIGS. 21 and 22.

Figure 21:
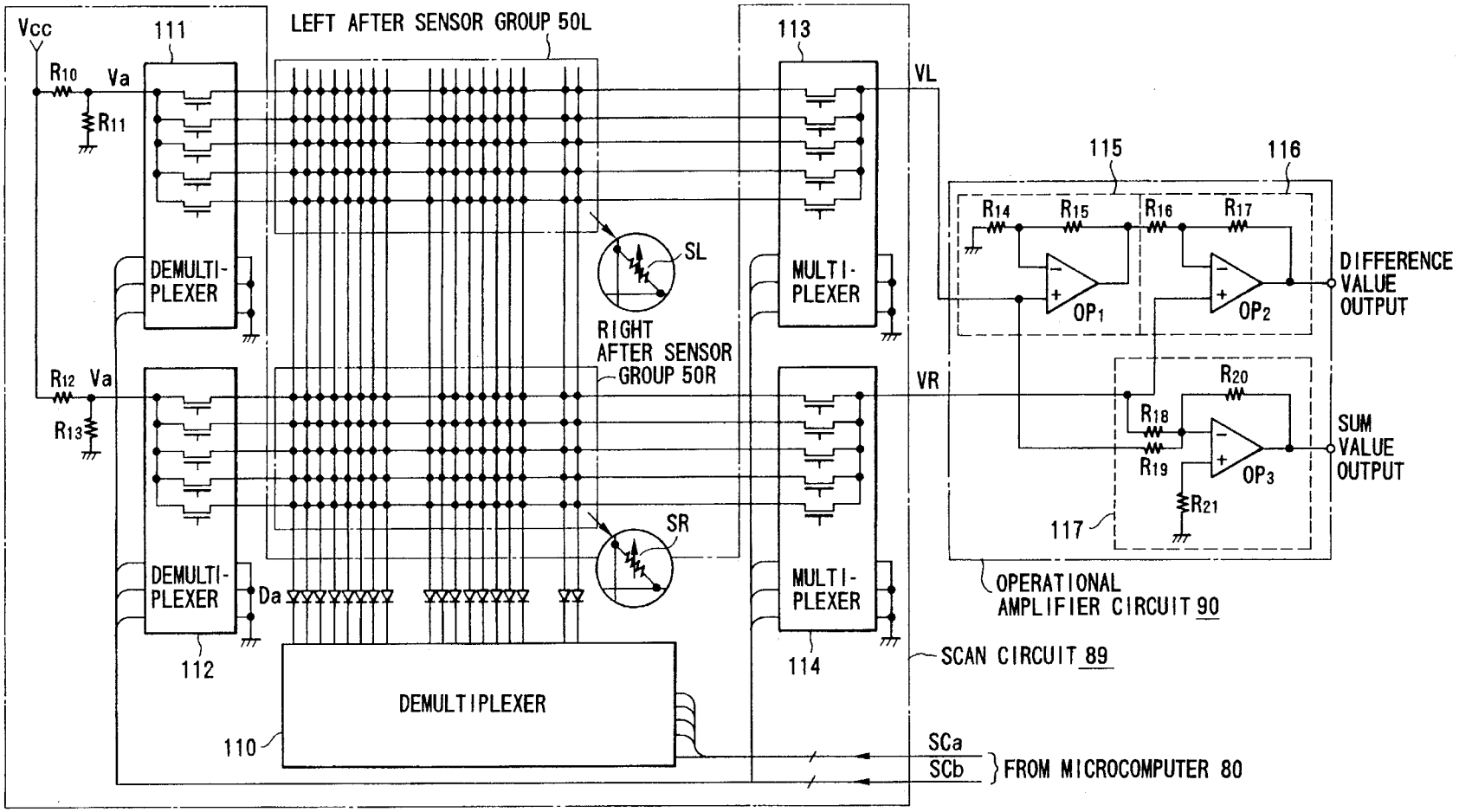
FIG. 21 is a block diagram showing an after sensor matrix circuit, a scan circuit 89, and an operational amplifier circuit 90 of an after sensor unit 50 in FIG. 13.

As shown in FIG. 21, the 88 pairs of left and right after sensors SL and SR of the after sensor unit 50, which pairs respectively correspond to the 88 keys, are divided into a left after sensor group 50L and a right after sensor group 50R, and a matrix circuit is formed by 18 common vertical scan lines and ten horizontal scan lines (five horizontal scan lines for each group). The left or right after sensors SL or SR are connected to all the intersections (except for two points) in the matrix circuit.

The scan circuit 89 comprises three demultiplexers 110, 111, and 112, and two multiplexers 113 and 114 and is operated in accordance with scan control signals SC*a* and SC*b* from the microcomputer 80.

The demultiplexers 111 and 112 and the multiplexers 113 and 114 are simultaneously operated in accordance with the scan control signal SC*b*. The demultiplexer 111 sequentially applies a signal of a voltage Va having a relatively long predetermined pulse width and obtained by voltage-dividing a power source voltage Vcc across resistors R10 and R11 to the five scan lines of the left after sensor group 50L at timings shifted by this pulse width while the signal is sequentially shifted by this pulse width.

The demultiplexer 112 also applies a signal of the voltage Va obtained by voltage-dividing the power source voltage Vcc across resistors R12 and R13 to the five horizontal scan lines of the right after sensor group 50R in the same order and timings as those of the demultiplexer 111.

The multiplexers 113 and 114 selectively connect the same horizontal scan lines to the output terminals at the same timings as those of the demultiplexers 111 and 112.

The demultiplexer 110 sequentially sets the 18 vertical scan lines through the corresponding diodes Da at different timings within the period in which the demultiplexers 111 and 112 apply the voltage Va to the horizontal scan lines within one cycle.

When the after sensors SL and SR are kept released, they have high resistances (i.e., in an semi-insulated state). For this reason, the voltage Va applied to the horizontal scan lines is directly inputted to the multiplexers 113 and 114 and serves as sensor outputs VL and VR. However, when the after sensors SL and SR are kept depressed in the last period of key depression or by the after touch upon key depression, the resistances of these sensors are decreased. Voltages at the horizontal scan lines are decreased with decreases in resistance values. The sensor outputs VL and VR from the multiplexers 113 and 114 are decreased.

As described above, the sensor outputs VL and VR from each pair of the left and right after sensor group 50L and 50R are simultaneously detected each at a time.

The sensor outputs VL and VR have almost the same level or different levels depending on pressures acting on the left and right after sensors SL and SR.

The left and right sensor outputs VL and VR are inputted to the operational amplifier circuit 90. After the left sensor output VL is amplified by an amplifier 115, a difference between the amplified left sensor output VL and the right sensor output VR is calculated by a difference value arithmetic circuit 116, thereby obtaining a difference value output.

On the other hand, a sum of the sensor outputs VL and VR is calculated by a sum value arithmetic circuit 17, thereby obtaining a sum value output.

Note that the amplifier 115 constitutes a noninverting amplifier having an operational amplifier OP1 and resistors R14 and R15. The difference value arithmetic circuit 116 comprises an operational amplifier OP2 and resistors R16 and R17. The sum value arithmetic circuit 17 comprises addition resistors R18 and R19, an operational amplifier OP3, and resistors R20 and R21.

Figure 22:
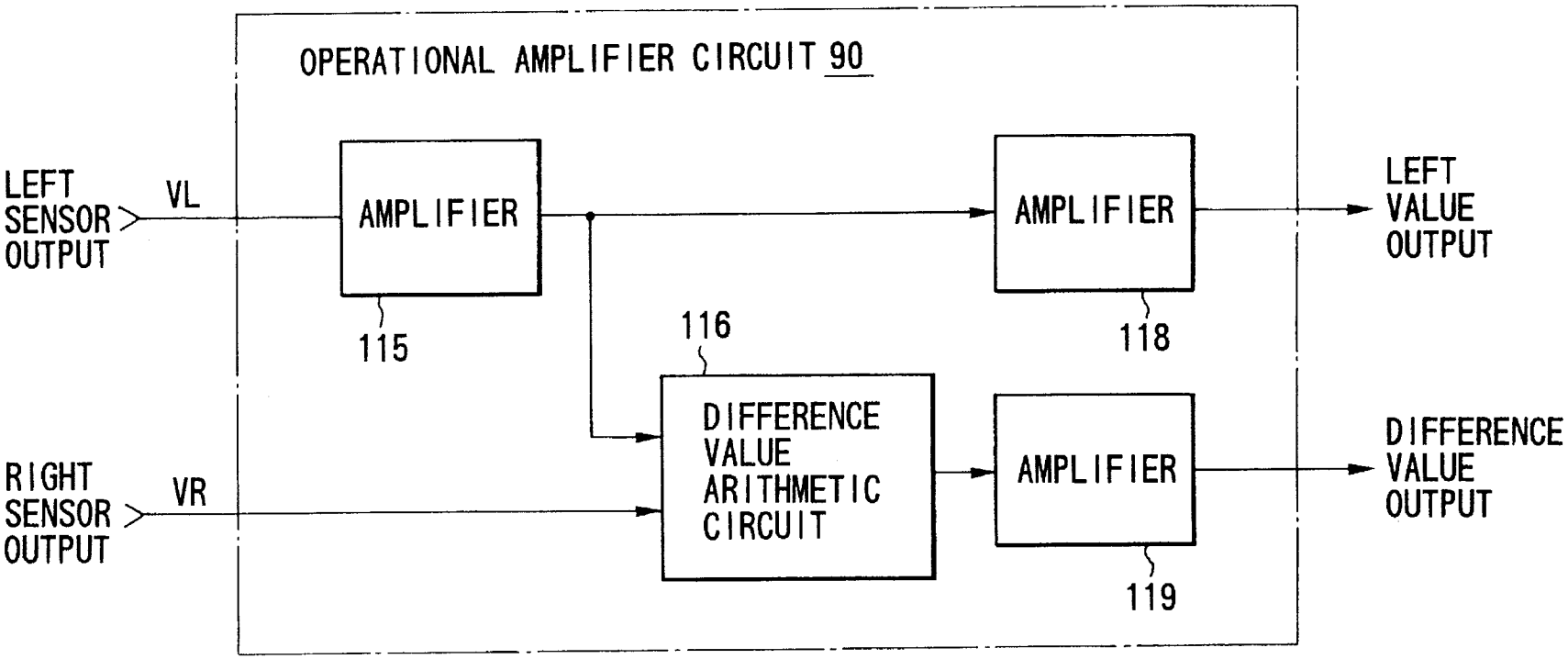
FIG. 22 is a block diagram showing another arrangement of the operational amplifier.

FIG. 22 shows another arrangement of the operational amplifier circuit.

This operational amplifier circuit 90' comprises a difference value arithmetic circuit 116, and three amplifiers 115, 118, and 119. The left sensor output VL is amplified by the amplifiers 115 and 118 as a left value output. The left value output amplified by the amplifier 115 is inputted to the difference value arithmetic circuit 116 together with the right sensor output to calculate a difference therebetween. The difference is amplified by the amplifier 119, and the amplified value is outputted as a difference value output.

In this arrangement, the left sensor output is amplified and defined as the left value output. However, the right sensor output may be amplified and defined as a right value output.

The difference value output and any one of the left value output, the right value output, and the sum value output are fetched by the microcomputer 80 in FIG. 13. A musical tone signal generated by the sound source circuit is modulated for the depressed key in accordance with the difference value output, thereby obtaining an effect such as a touch vibrato. At the same time, the volume and tone color (this tone color has a broad meaning so as to include the depth of reverberation and panning) of the musical tone can be controlled in accordance with one of the left value output, the right value output, and the sum value output, thereby performing after touch control. Different parameters of a musical tone signal can be controlled in accordance with the difference and sum value outputs. That is, the after touch and touch vibrato effects can be assigned to all the keys independently of each other.

Processing by Microcomputer

Processing of the CPU 81 in the microcomputer 80 in FIG. 13 will be described with reference to flow charts of FIGS. 23 to 30 and views from FIG. 31.

<Main Routine>

Figure 23:
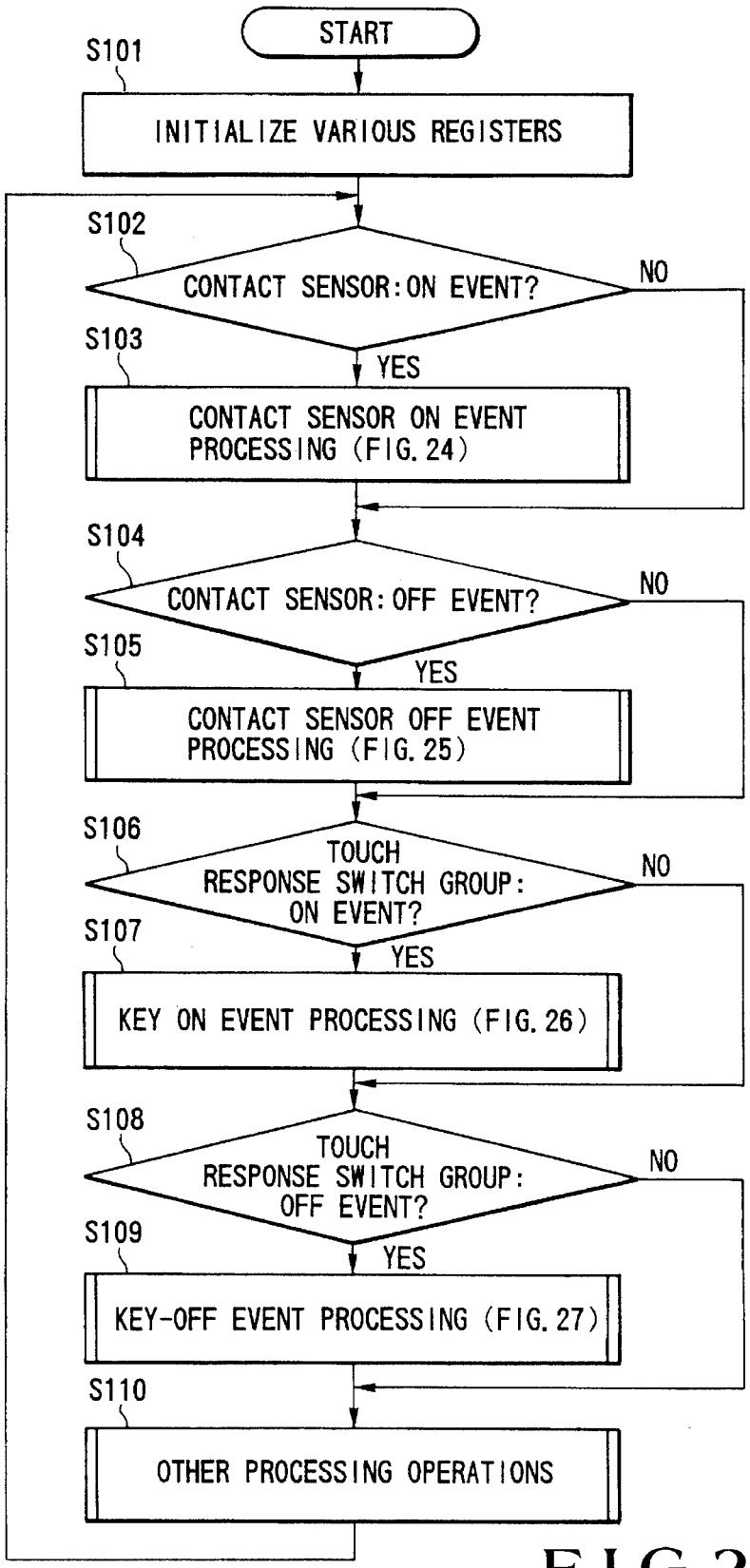
FIGS. 23 to 30 are flow charts showing processing operations of a CPU 81 in the microcomputer 80 shown in FIG. 13.

FIG. 23 shows a main routine. When the routine is started, various registers (to be described later) are initialized in step 101 (to be referred to as S101 hereinafter).

In S102, the CPU 81 determines whether an ON event for turning on any contact sensor in the contact sensor group 24 occurs. If YES in S102, contact sensor ON event processing (FIG. 24) is executed (S103).

The CPU 81 determines in S104 whether an OFF event for turning off any contact sensor of the contact sensor group 24 occurs. If YES in S104, contact sensor OFF event processing (FIG. 25) is executed (S105).

The CPU 81 determines in S106 whether an ON event for turning on any touch response switch of the tough response switch group 30G occurs. If YES in S106, key ON event processing (FIG. 26) is executed (S107).

The CPU 81 determines in S108 whether an OFF event for turning off any touch response switch of the touch response switch group 30G occurs. If YES in S108, key OFF event processing (FIG. 27) is executed (S109), and other processing operations are executed (S110). The flow returns to the decision block of the contact sensor group ON event.

Other processing operations are a plurality of operations such as setup or a change of a tone color switch, setup or a change of a rhythm switch, and setup and a change of an ON/OFF states of various effects. These operations are not closely related to the present invention and are grouped in one block.

Subroutines of the above processing will be sequentially described below. Prior to this description, various registers used in the various processing operations will be described below.

DESCRIPTION OF VARIOUS REGISTERS

C1BUF: a key ON event buffer; this buffer is an event buffer for temporarily storing a key code of a touched key. ON events occurring during one scan time can be accepted up to the (i+1)th (e.g., i=7) key ON event.

CTACT: a contact sensor register; this register continuously stores a key code of each key when a finger is kept in contact with a key surface, provided that the data C1BUF(i) are assigned to finite channels (e.g., 16 channels).

$n_0$: a channel number; the channel number represents a number given when the data C1BUF(i) is assigned to the data CTACT($n_0$), and the maximum channel number is 16.

COBUF: a key OFF event buffer; this buffer is an event buffer register for temporarily storing a key code of a key upon release of a finger from a key.

KCR: a key channel register; this register is of a key channel associated with sound production of a sound source and stores key code data. The data KCR(n) represents a key code represented by a channel n of the sound source.

OP: a stroke sensor output; this output is a detection output from the stroke sensor 20 and is given as an analog voltage in this embodiment.

Z: a stroke sensor output register; this register stores a stroke sensor output as Z($n_0$) corresponding to the channel number $n_0$ of the key represented by the key code stored as the contact sensor data CTACT($n_0$).

OLD: a flag register; two moments are required to obtain a speed (i.e., a rate of change in displacement), and the first moment is required to only latch data. This register is set to identify latching.

ZP: a previous stroke sensor output register; this register stores the immediately preceding stroke sensor output.

V: a change rate register; this register stores data representing a rate of change (speed) of the stroke sensor output obtained by the registers Z and ZP.

CAL: a calculation flag; this flag represents "during calculation" when a contact time difference and data Vc are to be calculated.

$t_1$: a timer variable; this variable is used to measure time. During calculation for any one of the valid channels, the timer variable $t_1$ is set as $t_1 \leftarrow t_1+1$ by a timer 1 interrupt.

KONBUF: a switch ON event buffer; the MSB of this buffer represents a first/second make point, and other bits represent a key code. This register stores key codes represented by switch ON events simultaneously generated (or a one-key ON event which has a higher possibility than the two-key ON event) during scanning (the first make switches of all keys are scanned, and then second make switches of all keys are scanned) of the touch response switch group 30G consisting of keys from the key of the lowest pitch to the key of the highest pitch.

KOR: a key ON flag register; the number of key ON registers corresponds to the number of channels, and data stored in this register is represented in the form of "1/6".

T1: a time register; this register stores time T1.

V1: speed data; this data is obtained at time T1 in units of channels.

T2: a time register; this register stores time T2.

V2: speed data; this data is obtained at time T2 in units of channels.

Δt: a time difference register.

TOUCH: a conversion result register; this register stores a conversion result obtained when data of the time register data At is converted into data corresponding to a speed by a conversion table TBL.

TBL: a conversion table; this table is used to convert the data of the time difference register Δt into the data corresponding to the speed.

Vc: a correction value of V; this value is a correction value of V after a predetermined arithmetic operation is performed.

VEL: a change speed value register; this register stores a change speed value of the sound source.

KOFBUF: a switch OFF event buffer; this register stores key codes of switch OFF events simultaneously generated during one scan cycle of the touch response switch group 30G of all the keys.

AFT: an after touch flag; this flag is set at "1" with a lapse of a predetermined period of time after an after sensor output is generated.

A: an after sensor output register; this register stores the after sensor output as data $A(n_0)$ corresponding to the channel of the key represented by the key code stored as the register data $CTACT(n_0)$.

AP: a previous after sensor output register; this register stores an immediately preceding after sensor output.

OLDA: a flag register; two moments are required to obtain a rate of change in after sensor output, and the first moment is required to only latch data. This register is set to identify latching.

VA: an after change rate register; this register stores data representing a rate of change in after sensor output obtained by the registers A and AP.

AFV: a sound source after touch register; this register stores data for controlling the sound source by an after touch.

$n_0$,$n_1$,n channel numbers; the channel number $n_0$ represents a channel corresponding to an ON contact sensor, the channel number $n_1$ represents a channel corresponding to an ON stroke sensor, and n represents a channel corresponding to an ON touch response switch.

<Contact Sensor ON Event Processing>

Figure 24:
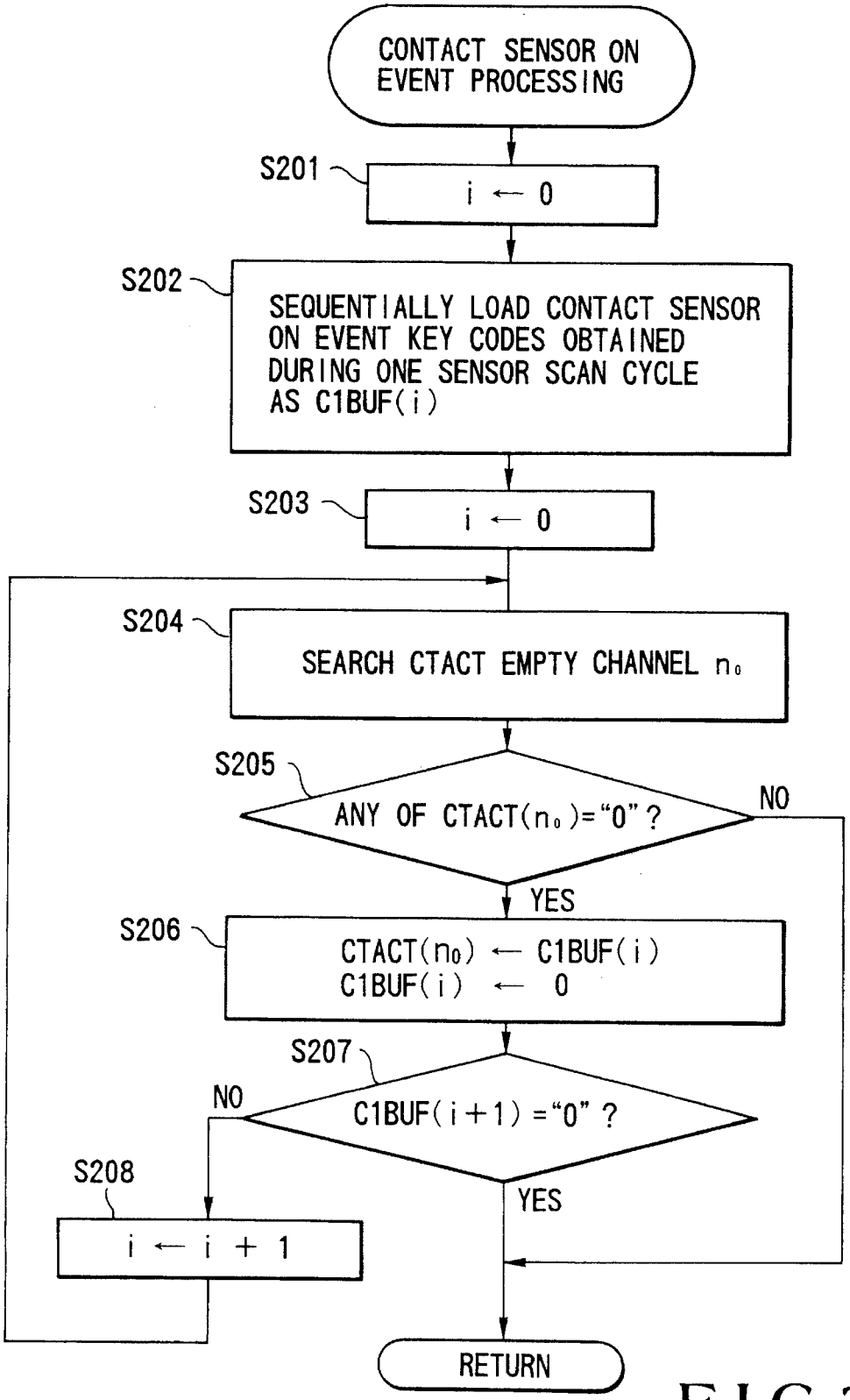

Contact sensor ON event processing will be described with reference to the flow chart of FIG. 24.

Figures 31, 32, 33, 34:
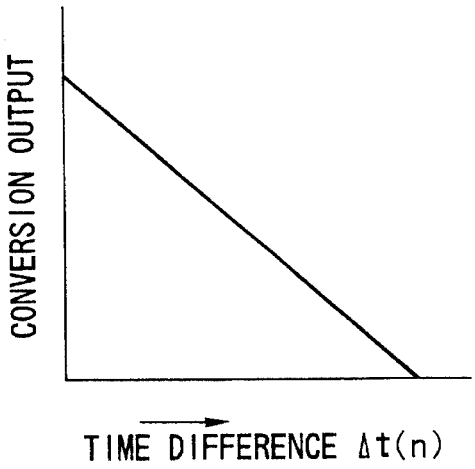
FIGS. 31 to 33 are views for explaining registers used in this embodiment.
FIG. 34 is a view for explaining a table for converting time difference data into date corresponding a speed.

In S201, an address i of the key ON event buffer C1BUF, as shown in FIG. 31, is set to 0. The address i represents one of eight key code storage areas 0 to 7. KC12, KC15, . . . in FIG. 31 represent key codes stored at addresses 0, 1, . . . , and "0" in the column of the key code represents that no key code is stored.

In S202, key codes (i.e., key codes of keys corresponding to contact sensors which are newly touched and turned on) of contact sensor ON events generated during one sensor scan cycle are sequentially loaded as the buffer data C1BUF(i). When this loading is completed, the address i is returned to "0" again in S203.

The channel number $n_0$ of the empty channel (ch) of the contact sensor register CTACT, as shown in FIG. 32, is searched in S204. Note that if the register CTACT is a 16-channel register, the number $n_0$ represents 1 to 16.

If any of the data $CTACT(n_0)$ is not "0" (empty), the flow in this subroutine directly returns to the main routine in S205. However, if it is "0", the key code stored as buffer data C1BUF(i) (initially i= 0) is stored in the empty channel of the register CTACT, and data C1BUF(i) is cleared to "0" (S206).

The CPU 81 determines in S207 whether remaining data (key codes) are stored in the buffer C1BUF, i.e., whether the data C1BUF(i+1) is "0". If YES in S207, the flow in the subroutine returns to the main routine. However, if NO in S207, some data are left in the buffer C1BUF. The address i is incremented to i+1 (S208), and operations from the search for an empty channel of the register CTACT are repeated again.

When all the key codes stored in the buffer C1BUF are completely transferred to the register CTACT or no empty channel is left in the register CTACT, processing is completed, and the flow in the subroutine returns to the main routine. Even if a performer touches a new key upon detection of the absence of the empty channel, this key input is neglected.

<Contact Sensor OFF Event Processing>

Figure 25:
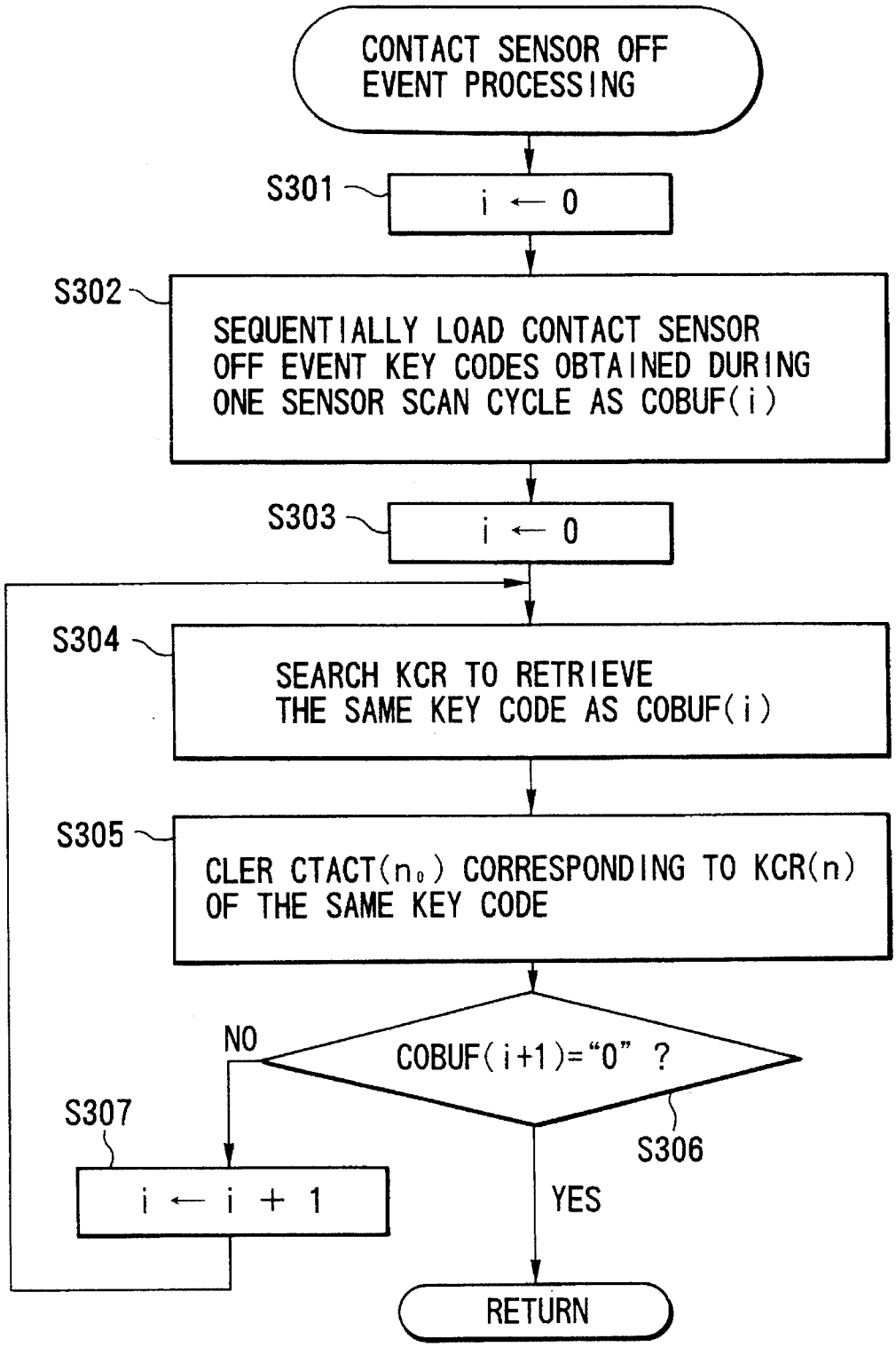

Contact sensor OFF event processing will be described with reference to the flow chart in FIG. 25.

In S301, an address i of the key OFF event buffer COBUF, as shown in FIG. 31, is set to "0". Key codes (i.e., key codes of keys corresponding to contact sensors which are newly turned off) of contact sensor OFF events during one sensor scan cycle are sequentially loaded as data COBUF(i) in S302. When loading of the key codes is completed, the address i is updated to "0" again in S303.

The key channel register KCR associated with sound production of the sound source is searched in S304 to retrieve the same key code as that stored as the data COBUF(i).

The contact sensor register data $CTACT(n_0)$ corresponding to KCR(n) having the same code as described above is cleared in S305.

The CPU 81 determines in S306 whether data (key codes) are left in the buffer COBUF, i.e., whether "0" is present as the data COBUF(i+1). If NO in S306, the flow in this subroutine returns to the main routine. However, if YES in S306, the address i is incremented to i+1 (S307). Operations from the KCR search are repeated.

<Key ON Event Processing>

Figure 26:
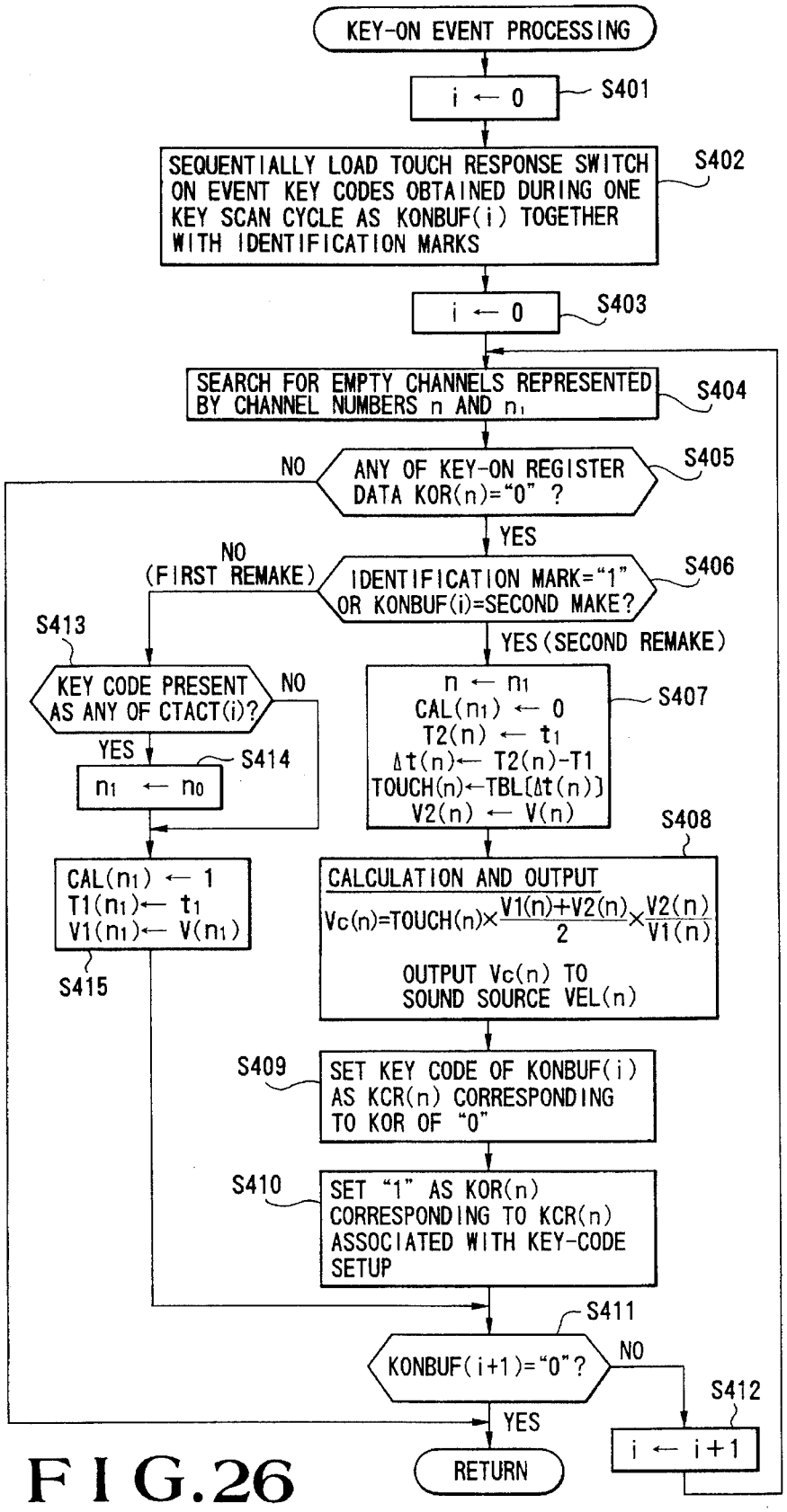

Key ON event processing will be described with reference to the flow chart in FIG. 26.

In S401, an address i of the switch ON event buffer KONBUF, as shown in FIG. 33, is set to "0".

Key codes (i.e., key codes of keys of first or second make switches S1 or S2 which are turned on) of ON events of the touch response switches during one key scan cycle are loaded as data KONBUF(i) together with identification marks (first make: 0; second make: 1), as shown in FIG. 33. When this loading is completed, the address i is updated to "0" again in S403.

In S404, the empty channel number n (i.e., the number representing the channel corresponding to the ON touch response switch) and the channel number $n_1$ (i.e., the number representing the channel corresponding to the ON stroke sensor) are searched.

The CPU 81 determines in S405 whether any one of the key ON flag register data KOR(n) is set to "0". If NO in S405, all the channels are busy, and the flow in this subroutine returns to the main routine.

If "0" is present as the data KOR(n), an empty channel is present. The CPU 81 determines in S406 in accordance with the identification mark whether the data KONBUF(i) represents the second make (i.e., identification mark: 1). If NO in S406, the make is the first make. The CPU 81 then determines in S413 whether a key code represented by the data KONBUF(i) of the contact sensor register CTACT is present.

If NO in S413, the channel number $n_0$ of the register CTACT is updated to the channel number $n_1$ in S414, and the next processing is executed.

In S415, the calculation flag data CAL($n_1$) is set as "1", the timer variable $t_1$ (i.e., a value representing the present moment) is set as the time register data T1($n_1$), and the speed data V2 is updated to data V($n_1$).

The data V($n_1$) of the register V represents a rate of change (speed) of the stroke sensor output of the channel $n_1$, obtained by the registers Z and ZP.

The CPU 81 determines in S411 whether data KONBUF(i+1) is "0", i.e., whether key codes are left in the buffer KONBUF. If NO in S411, the flow in this subroutine returns to the main routine. If YES in S411, the address i is updated to i+1 in S412. The flow returns to the step of determining whether any one of the data KOR(i) is "0".

If the data KONBUF(i) represents the second make in the step of determining whether it represents the second make in S406, the channel number $n_1$ is updated to the channel number n, and the calculation flag data CAL($n_1$) is set to "0". At the same time, the timer variable $t_1$ at this moment is stored as the time register data T2(n). In addition, a time difference between T2(n) and T1(n) is calculated and stored as the time difference register data Δt(n).

The time difference data Δt(n) is converted into data corresponding to key ON speed in accordance with the conversion table TBL shown in FIG. 34. A conversion result is stored as the conversion result register data TOUCH(n).

The change rate register data V(n) representing the rate of change (speed) of the stroke sensor output at this moment is defined as speed data V2 at time T2 (S407). By using these data, the following calculation is performed in S408 to obtain a correction value Vc(n) of the data V(n) as follows:

$$TOUCH(n) \times \frac{V1(n) + V2(n)}{2} \times \frac{V2(n)}{V1(n)}$$

This Vc(n) is outputted as the sound source speed rate value register data VLE(n) to control arbitrary parameters in addition to a musical tone volume level.

In S409, the key code represented by the switch ON event buffer data KONBUF(i) is set as the key channel register data KCR(n) corresponding to the key ON flag register KOR of "0". In S410, "1" is set as the KOR(n) corresponding to the data KCR(n) corresponding to this key code. The data T1(n), T1(n), V1(n), V2(n), TOUCH(n), and At are cleared.

The CPU 81 then determines in S411 whether the data KONBUF(i+1) is "0", i.e., whether a key code is left in the buffer KONBUF.

The purpose of correcting the data V(n) will be supplementarily described with reference to FIGS. 35A and 35B.

Figure 35B:
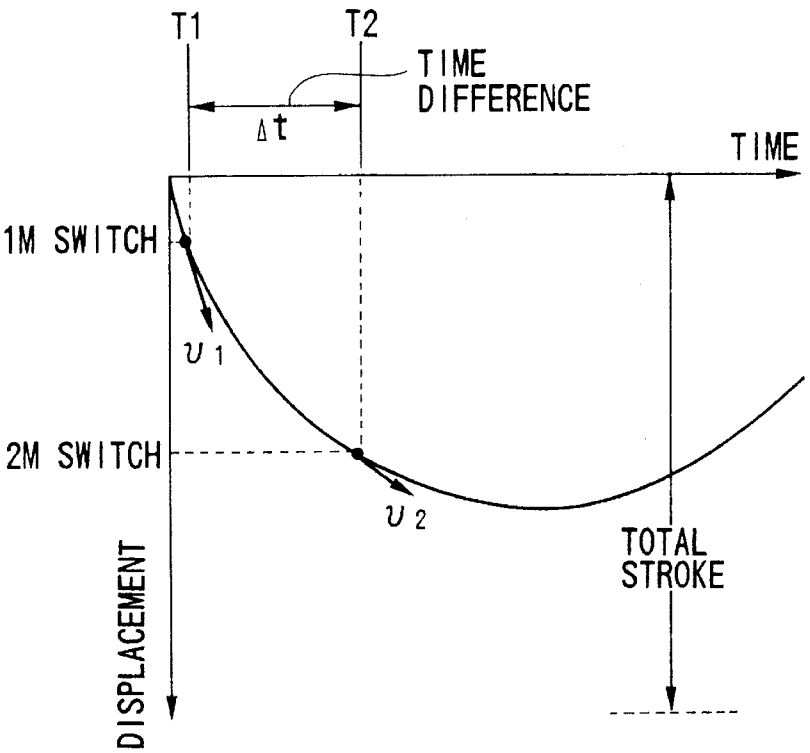
FIGS. 35A and 35B are views for explaining an operation for correcting contact time difference data of the touch response switches in consideration of a change in speed of the stroke sensor output.
Figure 35A:
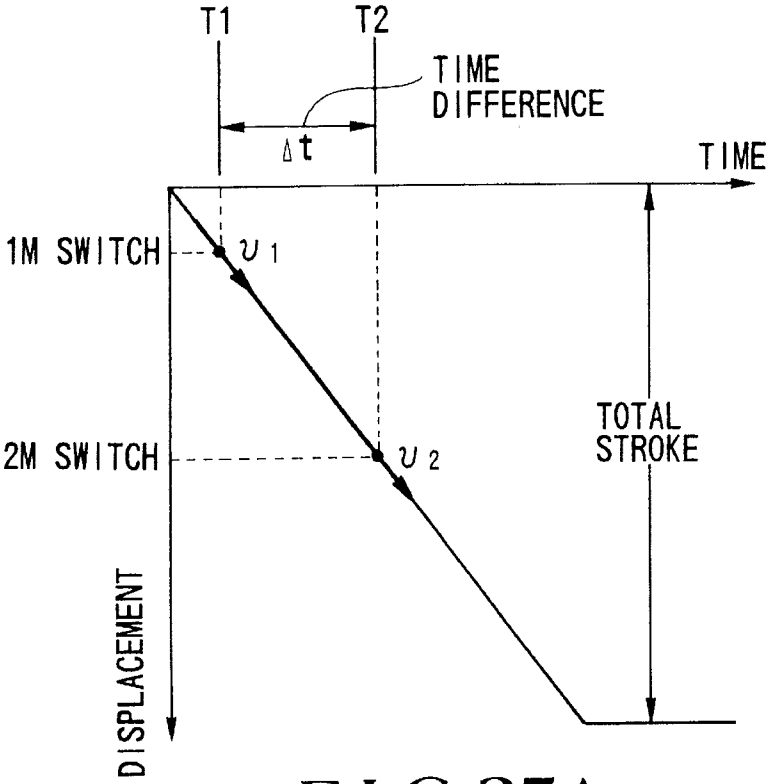
Figure 36A:
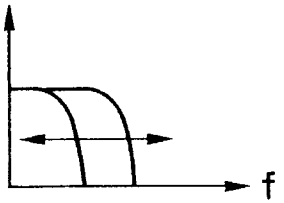
FIGS. 36A to 36G are views for explaining different characteristics in tone color control.
Figure 36B:
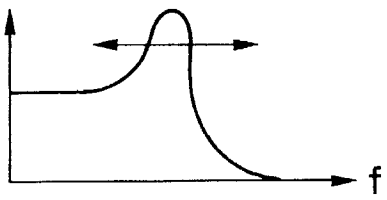
Figure 36C:
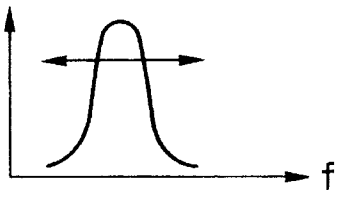
Figure 36D:
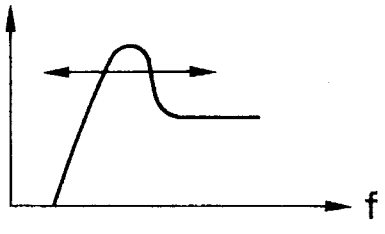
Figure 36E:
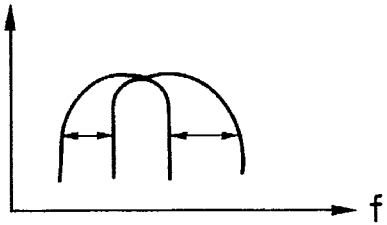
Figure 36F:
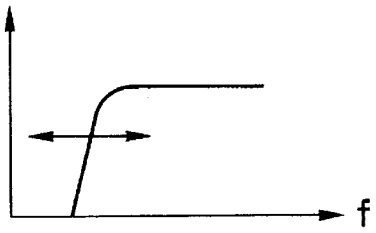
Figure 36G:
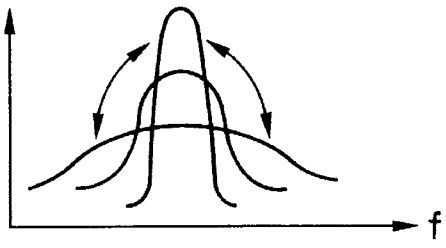

At the time of key ON operation, a key displacement in FIG. 35A is compared with that in FIG. 35B. Although the time difference At between the time T1 at which the first make (1M) switch of the touch response switch 30 is turned on and the time T2 at which the second make (2M) switch is turned on is kept unchanged, a displacement speed $v_1$ at time T1 is equal to that at time T2 in FIG. 35A, while the displacement speeds at time T1 and time T2 are changed to satisfy condition $v_1 > v_2$, as shown in FIG. 35B.

This is detected by the stroke sensor to set a volume level proportional to the following relation in the above case:

In the case of FIG. 35A:

If $v_1 = v_2 = v$, then $V = v$.

In the case of FIG. 35B:

If $v_1 = 1.5\ v$ and $v_2 = 0.5\ v$, then the following equation is obtained:

$$V = \frac{(1.5v + 0.5v)}{2} \times \frac{0.5}{1.5} = \frac{v}{3}$$

If $v_2 = 0$, then $V = 0$.

<Key OFF Event Processing>

Figure 27:
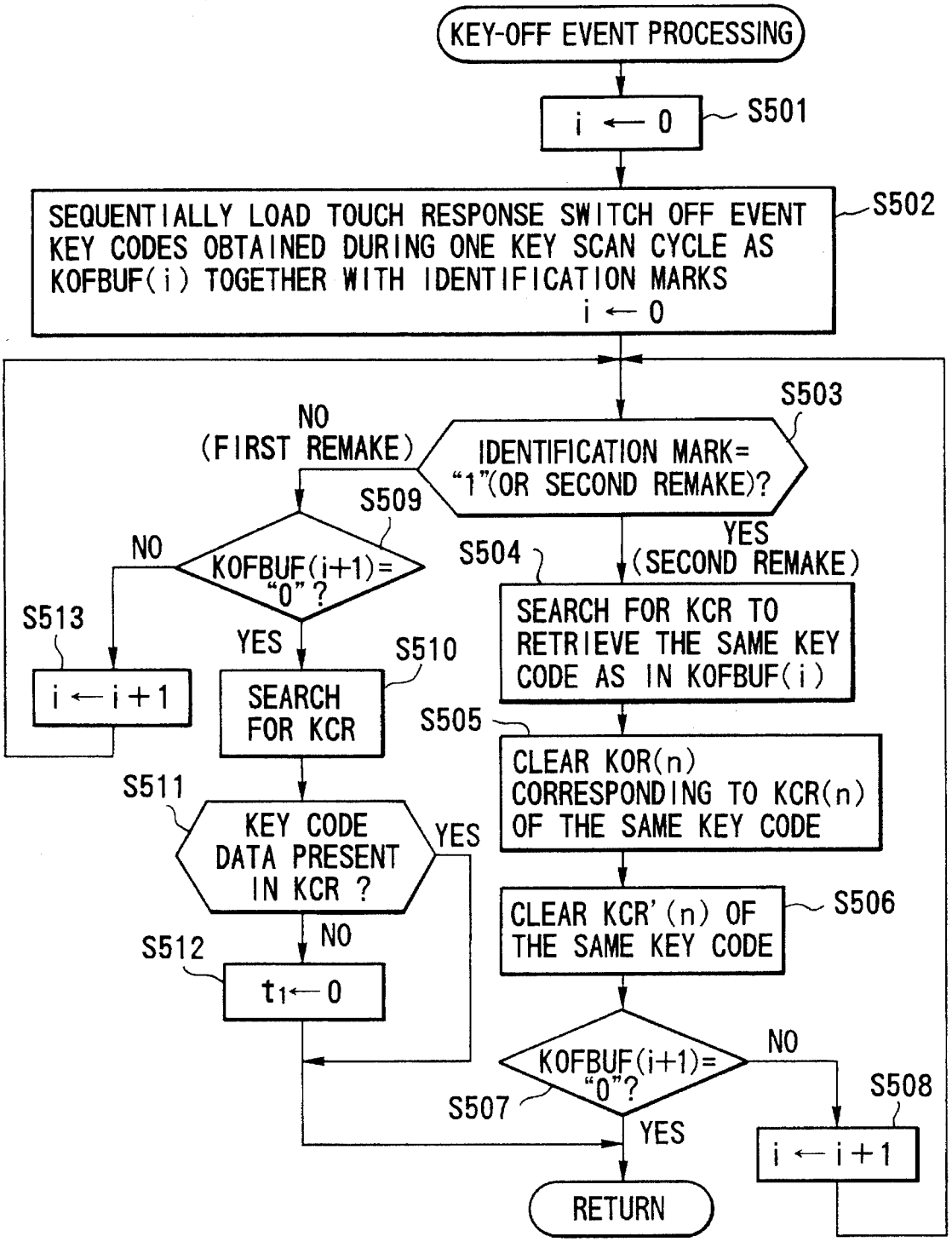

Key OFF event processing will be described with reference to the flow chart of FIG. 27.

In S501, an address i of the switch OFF event buffer KOFBUF, as shown in FIG. 33, is set to "0".

In S502, key codes (i.e., key codes of keys of first or second make switches S1 or S2 which are turned on) of ON events of the touch response switches during one key scan cycle are loaded as data KONBUF(i) together with identification marks (first remake: 0; second remake: 1). When this loading is completed, the address i is updated to "0".

The CPU 81 determines in S503 whether the data KOFBUF(i) represents the second remake. If NO in S503, this remake is the first remake. The CPU 81 determines in S509 whether the data KOFBUF(i+1) is "0", i.e., whether an OFF key code is present at the next address of the buffer KOFBUF. If NO in S509, the address i is updated to i+1 in S513, and the flow returns to the step of determining whether KOFBUF(i) represents the second remake.

If KOFBUF(i+1) is "0" (YES), the key channel register KCR is searched (S510). If key code data is present in S511, the flow in this subroutine directly returns to the main routine. Otherwise, the timer variable $t_1$ is cleared (S512) to finish the event processing, and the flow in this subroutine returns to the main routine.

If the data KOFBUF(i) represents the second remake in S503, the key channel register KCR is searched to retrieve the same key code as the data KOFBUF(i) (S504). In S505, the key ON flag register data KOR(n) corresponding to the data KCR(n) representing the same key code is cleared in S505. The data KCR(n) corresponding to the same key code is also cleared in S506.

The CPU 81 determines in S507 whether the data KOFBUF(i+1) is "0". If YES in S507, the event processing is completed, and the flow in this subroutine returns to the main routine. However, if NO in S507, since a key code of an OFF event is left in the buffer KOFBUF. In S508, the address i is updated to i+1. The flow returns to the step (S503) of determining whether the data KOFBUF(i) represents the second remake.

<Timer Interrupt>

Timer interrupts include a timer 1 interrupt, a timer 2 interrupt, a timer 3 interrupt which are cyclically called from the main routine in response to interrupt signals $T_1$, $T_2$, and $T_3$ outputted from the timer circuit 84 (FIG. 13) at short time intervals.

Note that the interrupt signals $T_1$, $T_2$, and $T_3$ satisfy condition $T_1<T_2<T_3$. These signals $T_1$ and $T_2$ are not associated with the time registers T1 and T2.

Figure 28:
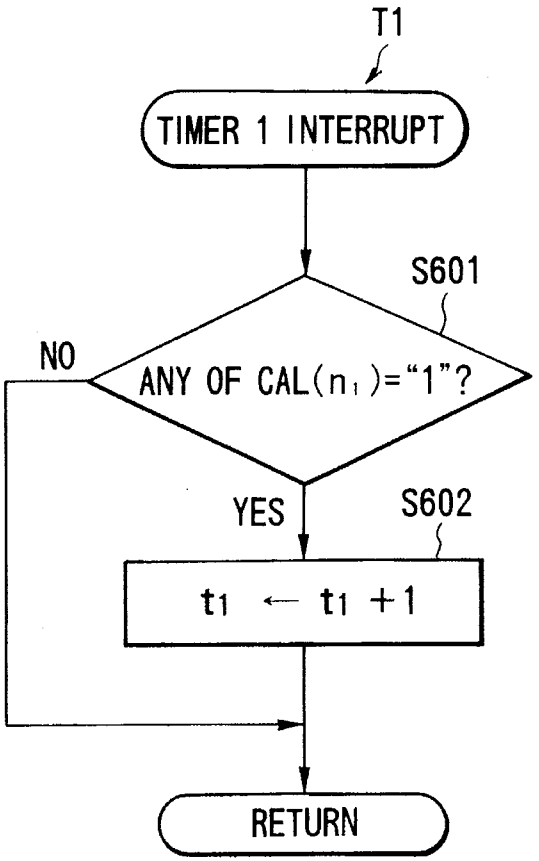

The timer 1 interrupt processing will be described with reference to the flow chart in FIG. 28.

In the timer 1 interrupt routine, the CPU 81 determines in S601 whether any of the calculation flag data $CAL(n_1)$ is "1" (the first make in the key ON event processing is "1"). If NO in S601, the flow in this subroutine returns to the main routine. However, if YES in S601, the time variable $t_1$ is incremented for time measurement in S602, and the flow in this subroutine returns to the main routine.

The timer 2 interrupt processing will be described with reference to the flow chart in FIG. 29.

In the timer 2 interrupt routine, in S701, the channel number $n_0$ of the contact sensor register CTACT is reset to 0. The CPU 81 determines in S702 whether condition $n_0>16$ is satisfied. If YES in S702, the after touch flag AFT (to be described in detail later) is set to "0" (S719), and the flow in this subroutine returns to the main routine. Since step S702 is initially determined to be NO, the CPU 81 determines in S703 whether $CTACT(n_0)$ is "0" (the absence of a key code). If YES in S703, the channel number $n_0$ is incremented (S720), and the flow returns to the step (S702) of determining condition $n_0>16$ is satisfied.

If a key code is, however, present, the following processing is performed, and the channel number $n_0$ is incremented. The flow then returns to the step of determining whether condition $n_0>16$ is satisfied.

When the above processing is repeated 16 times, 16-channel processing is completed. Since condition $n_0>16$ is satisfied, the flag AFT is reset to "0", and the flow in this subroutine returns to the main routine.

Processing executed when a key code is represented by the data $CTACT(n_0)$ is performed to load as the stroke sensor output register data Z(n) the stroke sensor output of the key represented by this key code (S704).

The CPU 81 then determines in S705 whether the after touch flag AFT is "1". If AFT=0, then only processing for the stroke sensor output is executed. However, if AFT=1, then processing for the after sensor output is performed, and then processing for the stroke sensor output is performed.

More specifically, if AFT=0, then the CPU 81 determines in S706 whether the flag register data OLD(no) is "0". If YES in S706, the data OLD(no) is set to "1" (S708). However, if NO in S706, a difference $Z(n_0)-ZP(n_0)$ between the current and previous stroke sensor outputs is stored as the change rate register data $V(n_0)$ (S707).

The data $V(n_0)$, i.e., the change rate data of the stroke sensor output within a short period of time is outputted to various sound source registers and stored therein. This data is then used for controlling musical tone parameters, as needed, and its application will be described later.

In S709, the present data Z(n0) is transferred to $ZP(n_0)$. In S710, the CPU 81 determines whether the data $V(n_0)$ is smaller than a predetermined value (i.e., $V<V_0$ where $V_0$ is the predetermined value). If NO in S710, the flow immediately returns to the step of determining whether condition $n_0>16$ is satisfied. If YES in this decision block, the flag register data $OLD(n_0)$ is cleared (S711), and the flow returns to the step of determining whether condition $n_0>16$ is satisfied.

For example, the change rate data of the data $v(n_0)$ can be used for various types of control by setting various flags (Ft=1) in other processing operations of the main routine.

For example, if Ft=1, then a tone color to be produced upon ON operation of the second make switch of the touch response switch can be set prior to sound production.

That is, the above example can be utilized for princess tone color control. This is tone color change control by princess acceleration information.

The tone colors can be controlled in real time during sound generation in accordance with an all-sensing scheme.

When the data $V(n_0)$ is no longer used once it is sent, inputs to the sound source registers are inhibited until the contact sensor is turned off.

On the other hand, if AFT=1 in S705, the difference value output (e.g., the difference value output between the operational amplifier circuit 90 in FIG. 21 and the operational amplifier circuit 90' in FIG. 22) of the after sensor of the key represented by the key code of the contact sensor register data $CTACT(n_0)$ is loaded.

The CPU 81 determines in S713 whether the flag register data $OLDA(n_0)$ is "0". If YES in S713, the difference $A(n_0)-AP(n_0)$ between the current and previous difference value outputs of the after sensor is stored as the after change rate register data $VA(n_0)$ (S714).

The data $VA(n_0)$, i.e., the change rate data of the difference value outputs of the after sensor within a short period of time is outputted and stored as the sound source after touch register data AFV(n). This data is used for controlling necessary musical tone parameters, as needed.

In S716, the current data $A(n_0)$ is transferred to $AP(n_0)$. The CPU 81 determines in S717 whether $VA(n_0)$ is smaller than a predetermined value (i.e., $VA<VA_0$). If NO in S717, the flow immediately returns to the step of determining whether $D(n_0)=0$ or not. However, if YES in S717, the flow returns to the step of determining whether $D(n_0)=0$ or not after the data $OLDA(n_0)$ is cleared. Processing for the stroke sensor output is then performed.

Control applications of the musical tone parameters in accordance with the change rate data AFV(n) of the difference value outputs of the after sensor within the short period of time are exemplified such that a musical tone signal is modulated to control a pitch, a volume, and a tone color of this musical tone signal, that the depth and speed of a vibrato, the depth and speed of a tremolo, the depth and speed of a chorus, the depth and speed of pulsation, the magnitude and speed of a stereoscopic sound image, and the depth of reverberation are changed to provide various effects, thereby delicately reflecting the will of a performer.

If AFT=1, the following applications are available. For example, an after sensor output loaded as the after sensor output register data A(n0) serves as a sum value (i.e., the sum value output from the operational amplifier circuit 90 in FIG. 21) of the outputs from the right and left after sensors constituting the after sensor, or as one of the right and left after sensor outputs (e.g., the left value output from the operational amplifier circuit 90' in FIG. 22), and change rate data thereof are obtained. These change rate data are outputted and stored as the sound source after touch register data AFV(n) and can be used for controlling necessary musical tone parameters, as needed.

The change rate data of these after sensor outputs may be simultaneously obtained to control different parameters of the musical tone signals.

<Timer 3 Interrupt>

Timer 3 interrupt processing will be finally described with reference to the flow chart in FIG. 30.

In this timer 3 interrupt processing, if any after sensor output (i.e., a one-side value output or a sum value, but not a difference value) is detected in S801, the CPU 81 determines in S802 whether $t_3$=T10 (no problem occurs when $t_3$ is longer than $T_2$ by about 10 to 50 times) or not. If NO in S802, the variable $t_2$ is incremented (S803), and the flow in this subroutine returns to the main routine. However, if YES in S802, the after touch flag AFT is set to "1" in S804, and the variable $t_3$ is cleared in S805. The flow then returns to the main routine.

When the after touch flag AFT is set to "1", processing for obtaining the rate of change in after sensor output in the timer 2 interrupt routine can be performed.

Figure 30:
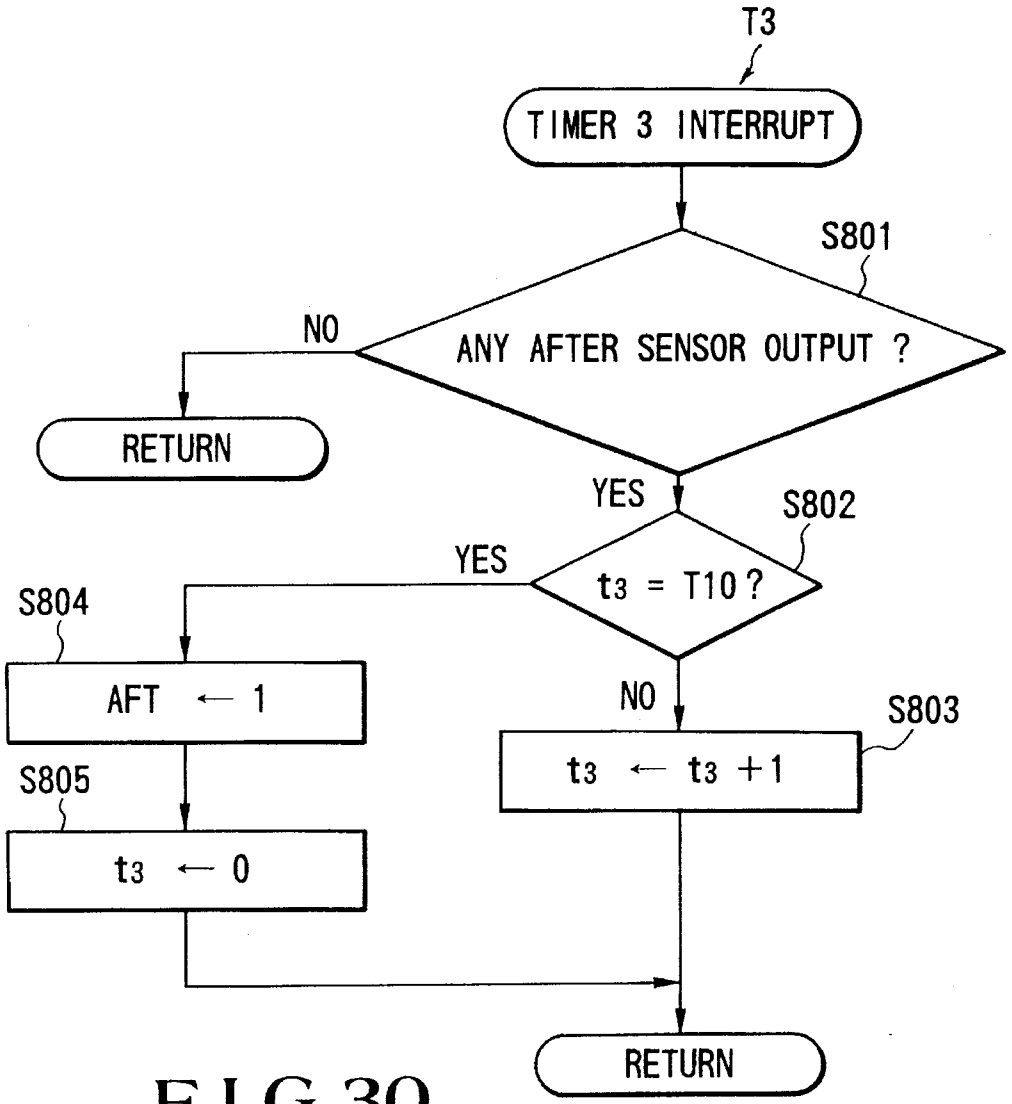
Figure 29:
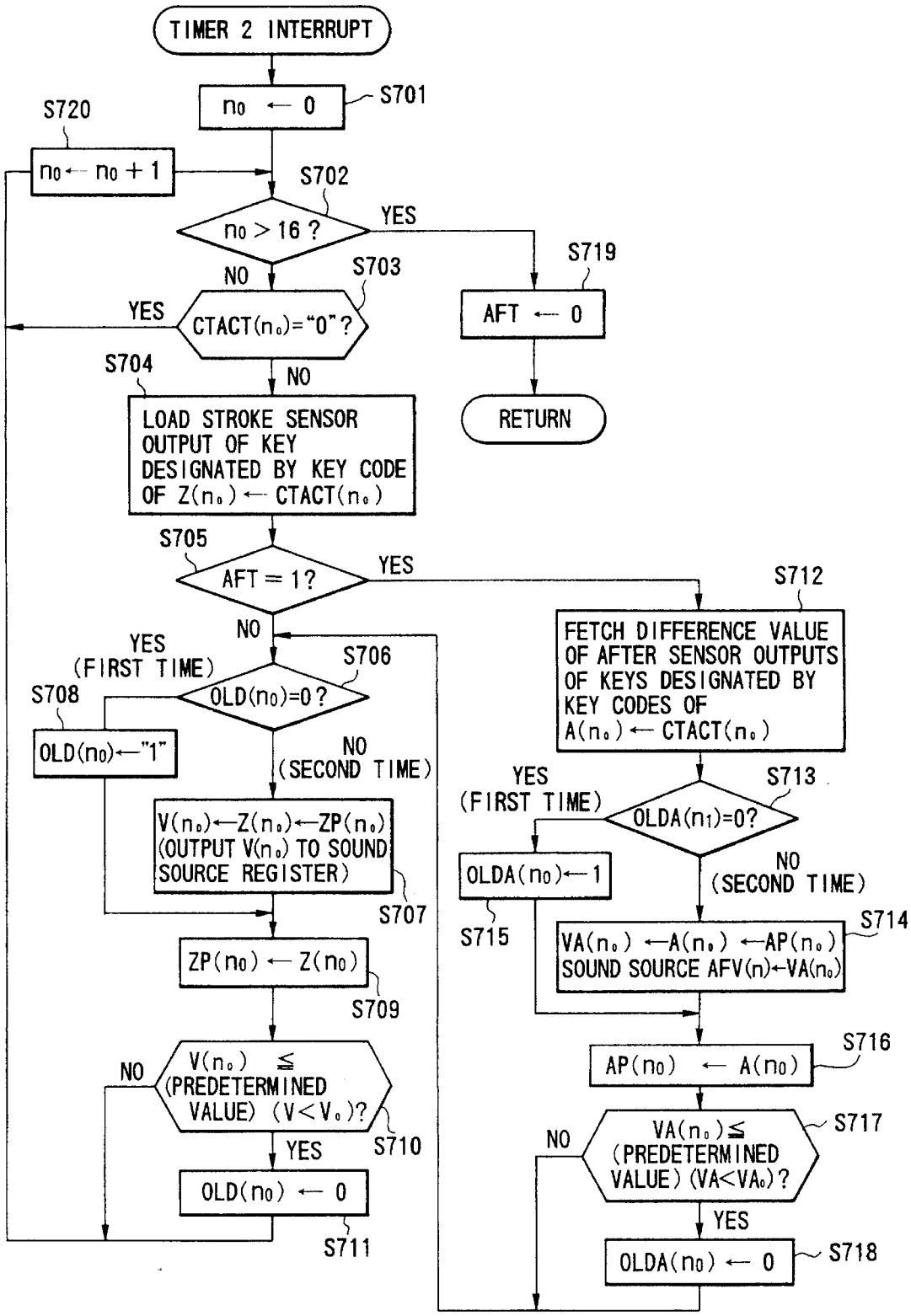

As is apparent from FIGS. 29 and 30, if an after sensor output is detected, a musical tone produced every time interval $T_3$ can be controlled to be changed by the after sensor output.

Effects of Embodiment

According to the embodiment described above, the key ON operation or depression of each key is detected by an initial sensor, and a musical tone during production or under control is controlled in accordance with two outputs independently outputted from each after sensor comprising two analog sensors. In addition to the key depression pressure and depth, the volume level and the tone color are changed or modulated in accordance with the way of key depression (i.e., inclination and vibration), thereby providing a variety of flexible and expressive musical control operations.

As the after sensor for each key, sensor pairs of the elongated after sensor unit extending in the alignment direction of the keys are symmetrical about its center, and signal input/output terminals are arranged at both ends of the elongated after sensor unit. The board arrangement for all keys and their wiring operations can be facilitated. Different outputs can be extracted from the sensor pair in accordance with an unbalance of pressures acting on the sensor pair in the direction of the width (right-and-left direction) of the key. The different outputs can be utilized for musical tone control.

By utilizing difference values of the outputs from the sensor pairs corresponding to the respective keys, musical tone signals corresponding to the maximum channels can be modulated to control the pitch, volume level, tone color, and the like. In addition, by modulation of the musical tone signal, the depth and speed of a vibrato, the depth and speed of a tremolo, the depth and speed of a chorus, the depth and speed of pulsation, the magnitude and speed of a stereoscopic sound image, and the depth of reverberation can be arbitrarily changed to provide various effects, thereby delicately reflecting the will of a performer.

In a polyphonic musical performance, e.g., in a performance of a chord, even if a musical instrument of temperament is used, an external force concentrated on a given position is slightly shifted to another position so that an "absolute pitch ratio" of the pitch of the nth note relative to that of the root or another note can be controlled to be an "integer multiple". As a result, a clear chordal or polyphonic sound can be produced.

In addition, the volume level can be controlled in accordance with a degree of strength of the concentrated external force. Even if another operation member such as an EXP pedal or a wheel is not operated, the performer plays the musical instrument while concentrating himself or herself on only a force (e.g., a force applied by a finger tip) acting on the after sensor, thereby facilitating an expressive musical performance.

In addition, the tone color can be controlled in accordance with the strength of the concentrated external force acting on a key or the like. As shown in FIGS. 36A to 36G, a modulation effect (indicated by an arrow) can be added while the tone color can be controlled in accordance with various characteristics, thereby also providing an expressive musical performance.

When the musical tone parameters are to be controlled in accordance with the sum values of the outputs from the sensor pairs, amounts of changes in parameters can be increased, and the dynamic sensing range can be increased. Therefore, the will of the performer can be delicately reflected, and the performer can achieve an expressive musical performance.

The range of musical expressions can be further widened in accordance with combinations of the above various control operations.

In addition to the contact time difference value between the ON timing of the first make switch and the ON timing of the second make switch of the touch response switch 30 for each key upon key depression, a rate of change in two moments during a time interval represented by the contact time difference value is obtained in accordance with an output from the stroke sensor for microscopically sensing this time interval. The contact time difference data is corrected in consideration of the rate of change. Different touch sensitivity outputs can be obtained in accordance with the ways of depressing the keys and movements of the keys although the contact time differences thereof are equal to each other.

When the musical tone is controlled in accordance with these touch sensitivity outputs, an expressive musical performance which faithfully reflects the will of the performer can be made.

Similarly, when keys are to be released, different touch sensitivity outputs corresponding to the ways of releasing the keys and movements of the keys can be obtained. The reverberation until the stop of the musical tone can be controlled.

The stroke sensor is located adjacent to the touch response sensor, and their movable projections are integrally formed by the same elastic material. Although a large number of sensors and switches are arranged, the keyboard structure will not be complicated, and assembly is also simplified.

The stationary portions of the stroke sensor and the touch response switch are formed on the common printed circuit board, and the wiring operations for the stationary portions can be performed by the wiring patterns formed on the upper and lower surfaces of the printed circuit board. Therefore, the wiring operations assembly, maintenance, and inspection can be further facilitated.

Through holes are not formed in the printed circuit board, and the wiring patterns on the upper and lower surfaces of the printed circuit board can be independently formed. Therefore, the printed circuit board can be easily manufactured.

Applicability of Present Invention

The above embodiment exemplifies an electronic musical instrument having a keyboard obtained such that a large number of keys are pivotally mounted on a keyboard frame serving as a key support portion. The present invention is not limited to this. For example, as described in Japanese Utility Model Laid-Open No. 61-196297, the present invention is also applicable to an electronic musical instrument having key switches, an electronic musical instrument having non-stroke keys for allowing a musical performance upon touching of the key pattern, and the like.

The present invention is not limited to a keyboard musical instrument or a polyphonic musical instrument. The present invention is also applicable to commercially available electronic wind instruments similar to wind instruments (generally monophonic musical instruments) which are controlled with mouths and beath, such as a trumpet, a flute, a recorder, and a clarinet.

In an acoustic wind musical instrument, an impressive musical performance can be made in accordance with matching between the breath, the reed or mouthpiece, and fingering. In a conventional electronic wind instrument, musical tones are not produced in consideration of slight differences in key touch. That is, musical tones are produced by simple key ON or OFF operations.

When the present invention is applied to such an electronic wind instrument, delicate musical tone control expressing the feelings of the performer can be performed.

For example, in a recorder, an impressive, delicate musical performance can be made by controlling both breath and the key touch. That is, by controlling the breath while the hole for the thumb is half open, thereby providing a delicate musical expression.

In an electronic recorder employing the present invention, a fingering key switch is constituted by a touch response switch, i.e., a contact time difference switch. A breath sensor or breath pressure sensor is constituted by a stroke sensor.

The characteristic feature of the present invention is to manage information of one sensor by information of the other sensor.

When the present invention is applied to an electronic musical instrument (handy electronic musical instrument) using the key switches, the contact time difference switches are caused to correspond to keys operated with the second, third, fourth fingers of the right hand, and the stroke sensor is caused to correspond to a key operated with the first finger.

What is claimed is:

1. An electronic musical instrument comprising:

a key support portion;

a plurality of keys pivotally supported on said key support portion;

musical tone signal generating means for generating a musical tone signal corresponding to each of said plurality of keys;

a plurality of after-sensors, each being associated with a different one of the plurality of keys and including a plurality of sensors and operated near key depression end positions for detecting aftertouch representing key touch after the associated key has been depressed, to independently generate pieces of key information, wherein each after-sensor detects a difference between adjacent key depression forces outputted from two sensors arranged parallel in a direction of a width of the key;

arithmetic operation means connected to said plurality of after-sensors for performing a predetermined operation on outputs of the plurality of sensors corresponding to said associated key and outputting an operation result; and musical tone signal control means for controlling said musical tone signal generating means in accordance with said operation result.

2. An electronic musical instrument according to claim 1, wherein the key information is at least one of a pressure acting on each sensor and position information in a direction of a depth of key depression.

3. An electronic musical instrument according to claim 1, wherein each after-sensor comprises not less than three sensors arranged longitudinally and transversely relative to the key and detects a key depression force in a back-and-forth direction, or a depression force in an oblique direction.

4. An electronic musical instrument according to claim 1, wherein said plurality of sensors of each after-sensor independently output analog signals corresponding to at least one of the pressure and the position information.

5. An electronic musical instrument according to claim 1, wherein said plurality of sensors of each after-sensor independently output digital signals corresponding to at least one of the pressure and the position information.

6. An electronic musical instrument according to claim 1, wherein said musical tone signal control means controls at least one of a volume level and a tone color of the musical tone signal in accordance with one of outputs from said plurality of sensors of each after-sensor.

7. An electronic musical instrument according to claim 1, further comprising sum value arithmetic means for calculating a sum value of outputs from said plurality of sensors of each after-sensor, and wherein said musical tone signal control means controls at least one of a volume level and a tone color of the musical tone signal in accordance with an output from said sum value calculating means.

8. An electronic musical instrument according to claim 1, further comprising sum value arithmetic means for calculating a sum value of outputs from said plurality of sensors of each after-sensor, and wherein said musical tone signal control means comprises second musical tone parameter control means for controlling a second musical tone parameter of the musical tone signal in accordance with an output from said sum value calculating means.

9. An electronic musical instrument according to claim 1, wherein each after-sensor includes an initial sensor arranged in correspondence with and operated during depression of the associated one of the plurality of keys, and wherein said musical tone signal control means controls generation of the musical tone signal in accordance with an output from said initial sensor.

10. An electronic musical instrument according to claim 9, wherein each said initial sensor comprises a key switch having first and second switches having a contact time difference, and a stroke sensor for microscopically sensing a time interval of operations of said first and second switches.

11. An electronic musical instrument according to claim 10, wherein each after-sensor includes arithmetic means for obtaining a rate of change in time between two arbitrary points within the time interval in accordance with an output from said stroke sensor and calculating output data of touch sensitivity for controlling the musical tone signal by adding the obtained rate of change thereto.

12. An electronic musical instrument according to claim 10, wherein said first switch of said key switch has a pair of contacts arranged in parallel to each other in a longitudinal direction of the keys and electrically connected in parallel to each other.

13. An electronic musical instrument according to claim 10, wherein a movable projection of said key switch and a movable projection of said stroke sensor, which are deformed upon key depression, are made of the same elastic material and located adjacent to each other.

14. An electronic musical instrument according to claim 10, wherein said key switch and said stroke sensor, which correspond to said each key, are located adjacent to each other along a longitudinal direction of the keys.

15. An electronic musical instrument according to claim 10, further comprising a printed circuit board fixed on said key support portion, and wherein a wiring pattern of a stationary portion of said stroke sensor and a wiring pattern of a stationary contact of said key switch are independently formed on both surfaces of said printed circuit board, respectively.

16. An electronic musical instrument comprising:

a key support portion;

a plurality of keys pivotally supported on said key support portion;

musical tone signal generating means for generating a musical tone signal corresponding to each of said plurality of keys;

a plurality of after-sensors, each being associated with a different one of the plurality of keys and including a plurality of sensors and operated near key depression end positions for detecting aftertouch representing key touch after the associated key has been depressed, to independently generate pieces of key information;

arithmetic operation means connected to said plurality of after-sensors for performing a predetermined operation on outputs of the plurality of sensors corresponding to said associated key and outputting an operation result;

musical tone signal control means for controlling said musical tone signal generating means in accordance with said operation result; and difference value arithmetic means for calculating a difference value between outputs from said plurality of sensors of each after-sensor, and wherein said musical signal control means controls said musical tone signal generating means on the basis of an output from said difference value calculating means.

17. An electronic musical instrument according to claim 16, wherein said musical tone signal control means controls said musical tone signal generating means to modulate the musical tone signal or assign an effect thereto.

18. An electronic musical instrument according to claim 16, wherein said musical tone signal control means comprises first musical tone parameter control means for controlling first musical tone parameter of the musical tone signal in accordance with an output from said difference value calculating means.

19. An electronic musical instrument comprising:

a key support portion;

a plurality of keys pivotally supported on said key support portion;

a plurality of initial sensors, each associated with and operated during depression of a different one of the plurality of keys;

musical tone signal generating means for generating a musical tone signal corresponding to each of the plurality of keys;

a plurality of after-sensors, each being associated with a different one of the plurality of keys and comprised of a plurality of sensors and operated near key depression end positions for detecting aftertouch representing key touch after the associated key has been depressed to independently generate pieces of key information;

first musical tone parameter control means for controlling a first musical tone parameter of the musical tone signal generated by said musical tone signal generating means in accordance with a difference value between outputs from said plurality of sensors of said after-sensors;

second musical tone parameter control means for controlling a second musical tone parameter of the musical tone signal generated by said musical tone signal generating means in accordance with one or a sum of the outputs from said plurality of sensors of said after-sensors;

arithmetic operation means connected to said plurality of after-sensors for performing a predetermined operation on outputs of the plurality of sensors corresponding to said associated key and outputting an operation result; and musical tone signal control means for controlling said musical tone signal generating means in accordance with said operation result.

20. An input apparatus for an electronic musical instrument, comprising:

a plurality of keys pivotally supported on a key support portion;

a plurality of initial sensors, each arranged in correspondence with and operated during depression of a different one of the plurality of keys; and a plurality of after-sensors, each being associated with a different one of the plurality of keys and comprised of a plurality of sensors and operated near key depression end positions for detecting aftertouch representing key touch after the associated key has been depressed, to independently generate pieces of key information in correspondence with a pressure acting thereon or position information in a direction of a depth of key depression, the plurality of sensors including plural sensors disposed in a widthwise direction of the associated key to provide a variety of outputs in response to key movement in a lateral direction, the variety of outputs being employed to control a musical tone generated by the associated key.

21. A touch sensitive apparatus for an electronic musical instrument, comprising:

a plurality of keys;

a plurality of key switches, each associated with a different one of said plurality of keys and having first and second switches having a contact time difference and operated during depression of the associated key;

a plurality of stroke sensors, each microscopically sensing a time interval of operations of said first and second switches of a different one of the plurality of key switches; and a plurality of arithmetic means, each obtaining a rate of change in time between two arbitrary points within a time interval in accordance with an output from a different one of the plurality of stroke sensors and calculating output data of touch sensitivity for controlling a musical tone signal by adding the obtained rate of change thereto, the stroke sensors including a plurality of sensors being disposed in a widthwise direction of each of the plurality of keys, and providing a variety of outputs in response to movement of the key in the lateral direction, the variety of outputs being applied to control musical tones generated by the key.

22. A keyboard apparatus for an electronic musical instrument, comprising:

a plurality of keys pivotally supported on a key support portion;

stroke sensors, arranged in correspondence with said plurality of keys, for outputting signals corresponding to key depression strokes of the respective keys; and key switches, arranged in correspondence with said plurality of keys and ON/OFF-controlled upon operations of the respective keys, for controlling generation of musical tone signals, wherein a movable projection of said key switch and a movable projection of said stroke sensor, which are deformed upon key depression, are made of the same elastic material and located adjacent to each other, and the stroke sensors include a plurality of sensors disposed in a widthwise direction of each of the plurality of keys, and providing a variety of outputs in response to movement of the key in the lateral direction, the variety of outputs being applied to control musical tones generated by the key.

23. A keyboard apparatus for an electronic musical instrument, comprising:

a plurality of keys pivotally supported on a key support portion;

stroke sensors, arranged in correspondence with said plurality of keys, for outputting signals corresponding to key depression strokes of the respective keys;

key switches, arranged in correspondence with said plurality of keys and ON/OFF-controlled upon operations of the respective keys, for controlling to generate musical tone signals; and a printed circuit board fixed on said key support portion, wherein a wiring pattern of a stationary portion of said stroke sensor and a wiring pattern of a stationary contact of said key switch are independently formed on both surfaces of said printed circuit board, respectively, and the stroke sensors include a plurality of sensors disposed in a widthwise direction of each of the plurality of keys, and providing a variety of outputs in response to movement of the key in the lateral direction, the variety of outputs being applied to control musical tones generated by the key.

* * * * *